US011034152B2

(12) United States Patent
Kato

(10) Patent No.: US 11,034,152 B2
(45) Date of Patent: Jun. 15, 2021

(54) LIQUID DISCHARGE HEAD, HEAD MODULE, HEAD DEVICE, LIQUID DISCHARGE DEVICE, AND LIQUID DISCHARGE APPARATUS

(71) Applicant: Masaki Kato, Tokyo (JP)

(72) Inventor: Masaki Kato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/795,998

(22) Filed: Feb. 20, 2020

(65) Prior Publication Data

US 2020/0290348 A1 Sep. 17, 2020

(30) Foreign Application Priority Data

Mar. 16, 2019 (JP) ..... JP2019-049226

(51) Int. Cl.
*B41J 2/145* (2006.01)

(52) U.S. Cl.
CPC ..... *B41J 2/145* (2013.01)

(58) Field of Classification Search
CPC ..... B41J 2/145
See application file for complete search history.

(56) References Cited

U.S. PATENT DOCUMENTS 10,751,998 B2 * 8/2020 Kato ..... B41J 2/14233
2009/0102907 A1 * 4/2009 Yamanaka ..... B41J 2/14274 347/94
2012/0069101 A1 3/2012 Kato et al.
2012/0160925 A1 6/2012 Hoisington et al.
2012/0206540 A1 8/2012 Kato et al.
2012/0206545 A1 8/2012 Kato et al.
2012/0212545 A1 8/2012 Mizukami et al.
2012/0229573 A1 9/2012 Mizukami et al.
2012/0236083 A1 9/2012 Mizukami et al.
2012/0320131 A1 12/2012 Kato et al.
2013/0021412 A1 1/2013 Nishimura et al.
2013/0050354 A1 2/2013 Kato et al.
2013/0070021 A1 3/2013 Nishimura et al.
2017/0001441 A1 1/2017 Kato
(Continued)

FOREIGN PATENT DOCUMENTS

JP 2002-307676 10/2002
JP 2014-166755 9/2014
(Continued)

*Primary Examiner* — Lamson D Nguyen
(74) *Attorney, Agent, or Firm* — Oblon, McClelland, Maier & Neustadt, L.L.P.

(57) ABSTRACT

A liquid discharge head includes a plurality of nozzles configured to discharge a liquid, the plurality of nozzles arrayed in a two-dimensional matrix forming a plurality of nozzle groups, a plurality of pressure chambers communicating with the plurality of nozzles, respectively, a plurality of supply ports communicating with the plurality of pressure chambers, respectively, a plurality of common-supply branch channels communicating with two or more of the plurality of pressure chambers through the plurality of supply ports, respectively, a plurality of collection ports communicating with the plurality of pressure chambers, respectively, and a plurality of common-collection branch channels communicating with two or more of the plurality of pressure chambers through the plurality of collection ports, respectively.

20 Claims, 21 Drawing Sheets

(56) References Cited

U.S. PATENT DOCUMENTS

| | | | |
|---|---|---|---|
| 2017/0151782 | A1 | 6/2017 | Takahashi et al. |
| 2019/0270310 | A1 | 9/2019 | Masuda et al. |
| 2019/0275793 | A1 | 9/2019 | Kato |
| 2019/0275797 | A1 | 9/2019 | Kato |

FOREIGN PATENT DOCUMENTS

| | | | |
|---|---|---|---|
| JP | 2015-036238 | | 2/2015 |
| JP | 2016-179555 | | 10/2016 |
| JP | 2019-155683 | | 9/2019 |
| WO | WO2009/142894 | A1 | 11/2009 |
| WO | WO2012/091867 | A2 | 7/2012 |

* cited by examiner

LIQUID DISCHARGE HEAD, HEAD MODULE, HEAD DEVICE, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-049226, filed on Mar. 16, 2019, in the Japan Patent Office, the entire disclosures of which is hereby incorporated by reference herein.

BACKGROUND

Technical Field

Aspects of the present disclosure relate to a liquid discharge head, a head module, a head device, a liquid discharge device, and a liquid discharge apparatus.

Related Art

A liquid discharge head includes a plurality of nozzles from which a liquid is discharged. The plurality of nozzles is arrayed in a two-dimensional matrix. The liquid is supplied to a pressure chamber from a supply-main channel through a supply-branch channel. The liquid is collected from the pressure chamber to a collection-main channel through a collection-branch channel. The liquid discharge head includes one or more bypass channels that connect the collection-branch channel and the supply-branch channel or the collection-branch channel and the supply-main channel.

SUMMARY

In an aspect of this disclosure, a liquid discharge head is provided that includes a plurality of nozzles configured to discharge a liquid, the plurality of nozzles arrayed in a two-dimensional matrix forming a plurality of nozzle groups, a plurality of pressure chambers communicating with the plurality of nozzles, respectively, a plurality of supply ports communicating with the plurality of pressure chambers, respectively, a plurality of common-supply branch channels communicating with two or more of the plurality of pressure chambers through the plurality of supply ports, respectively, a plurality of collection ports communicating with the plurality of pressure chambers, respectively, a plurality of common-collection branch channels communicating with two or more of the plurality of pressure chambers through the plurality of collection ports, respectively, a plurality of bypass supply ports, each of which is adjacent to one of the plurality of supply ports at each longitudinal end of one of the plurality of common-supply branch channels in one of the plurality of the nozzle groups, a plurality of bypass collection ports each of which is adjacent to one of the plurality of collection ports at each longitudinal end of one of the plurality of common-collection branch channels in the one of the plurality of nozzle groups, and a plurality of bypass channels connecting the plurality of bypass supply ports and the plurality of bypass collection ports, respectively.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
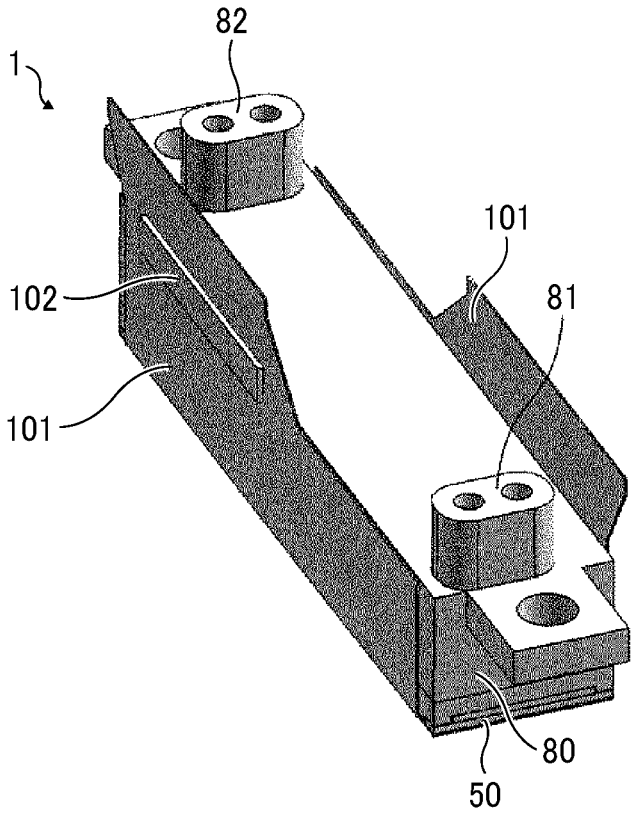
FIG. 1 is an outer perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. A liquid discharge head according to a first embodiment of the present disclosure is described with reference to FIGS. 1 to 8.

FIG. 1 is an outer perspective view of a liquid discharge head according to the present embodiment.

Figure 2:
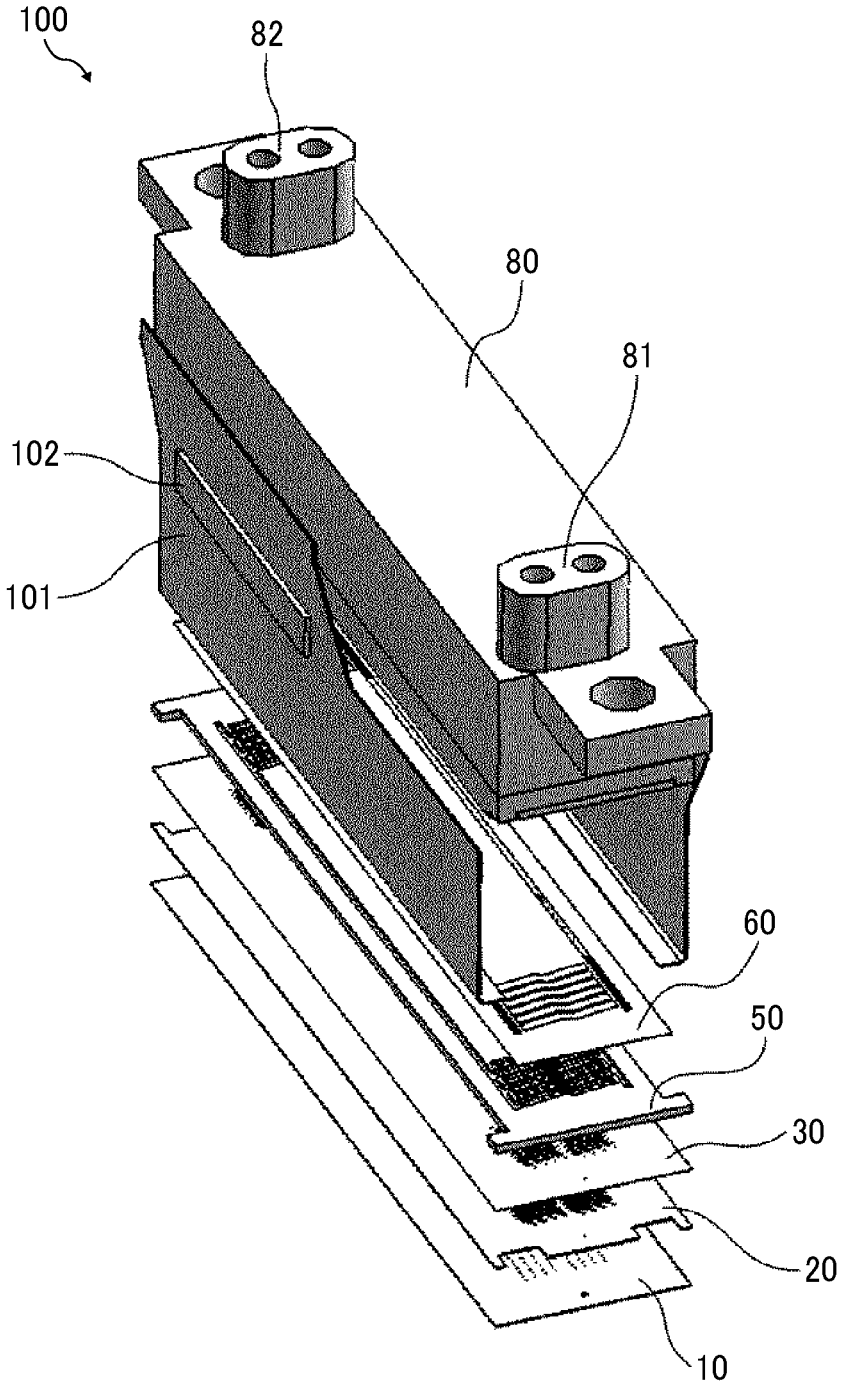
FIG. 2 is an exploded perspective view of the liquid discharge head in the first embodiment.

FIG. 2 is an exploded perspective view of the liquid discharge head.

Figure 3:
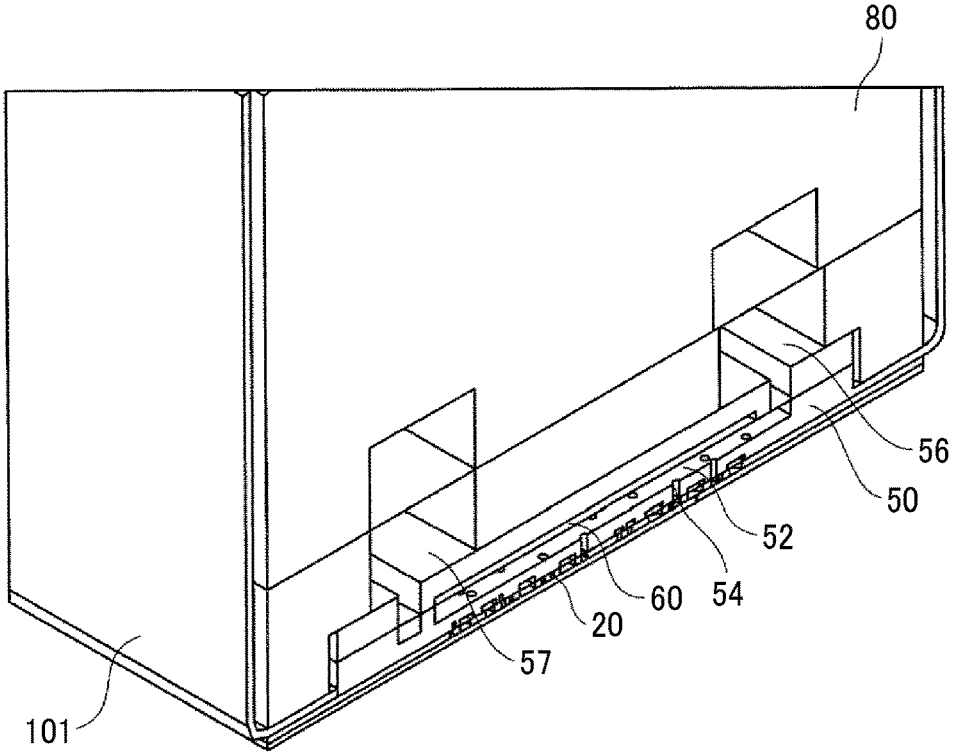
FIG. 3 is a schematic cross-sectional perspective view of the liquid discharge head in the first embodiment.

FIG. 3 is a cross-sectional perspective view of the liquid discharge head.

Figure 4:
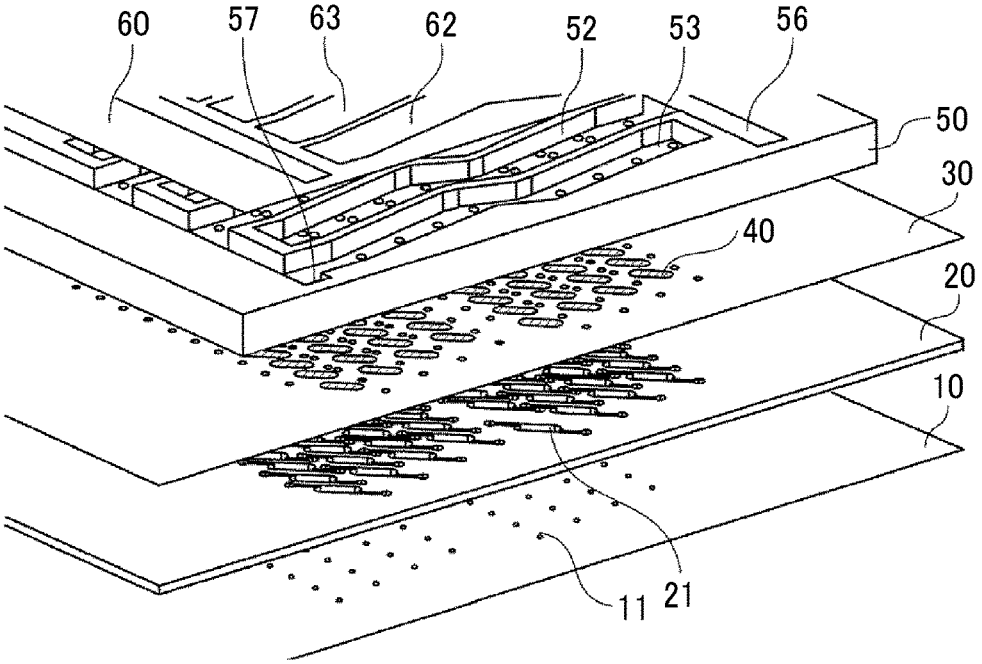
FIG. 4 is an exploded perspective view of the liquid discharge head without a frame in the first embodiment.

FIG. 4 is an exploded perspective view of the liquid discharge head excluding a frame.

Figure 5:
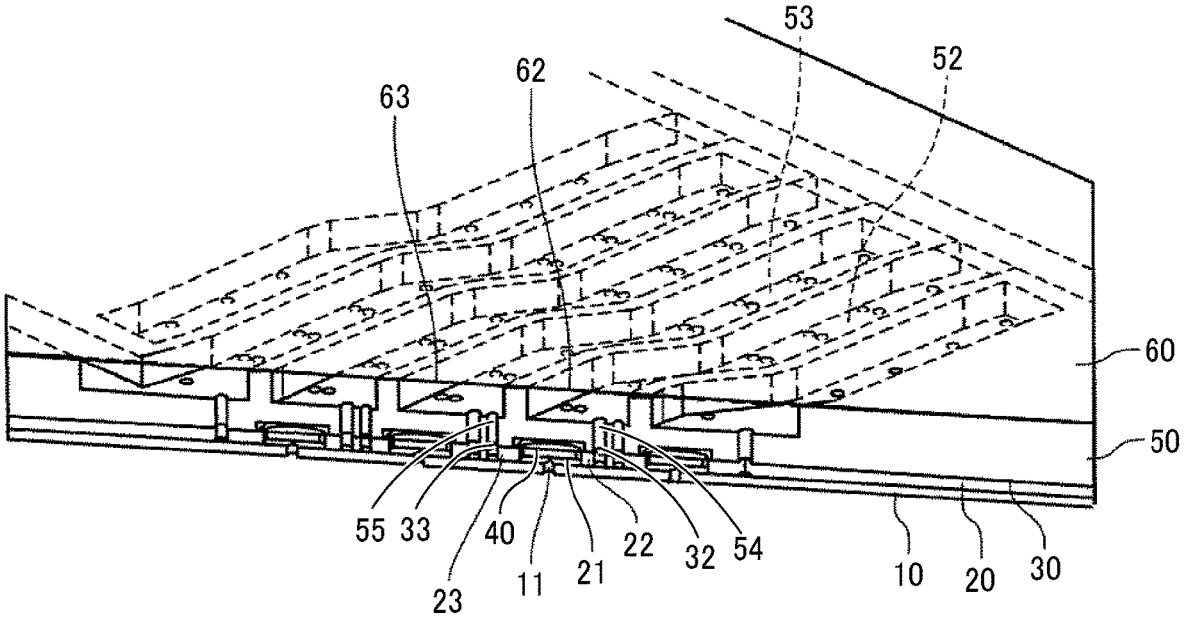
FIG. 5 is a cross-sectional perspective view of channels in the liquid discharge head in the first embodiment.

FIG. 5 is a cross-sectional perspective view of channels of the liquid discharge head.

Figure 6:
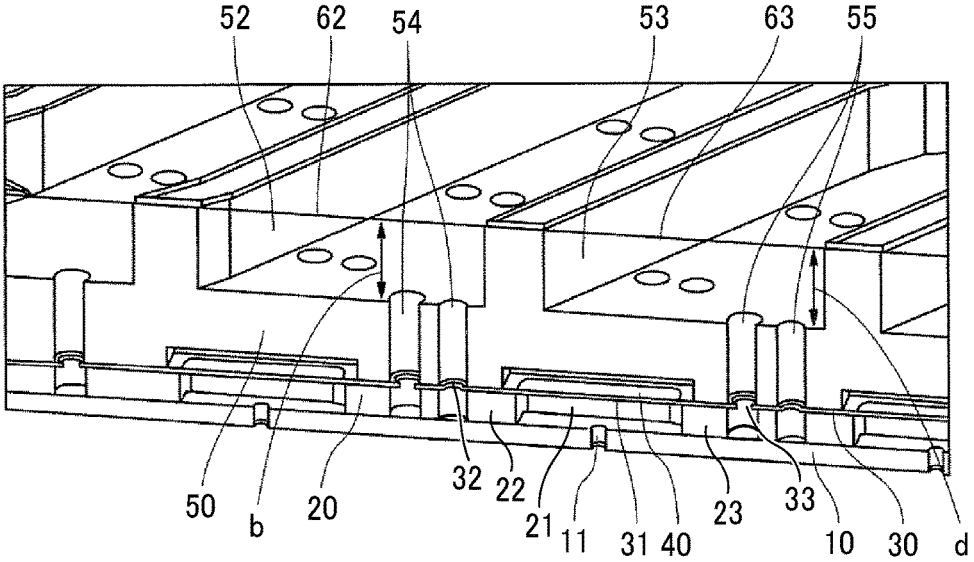
FIG. 6 is an enlarged cross-sectional perspective view of the channels in the first embodiment.

FIG. 6 is an enlarged cross-sectional perspective view of the channels of the liquid discharge head.

Figure 7:
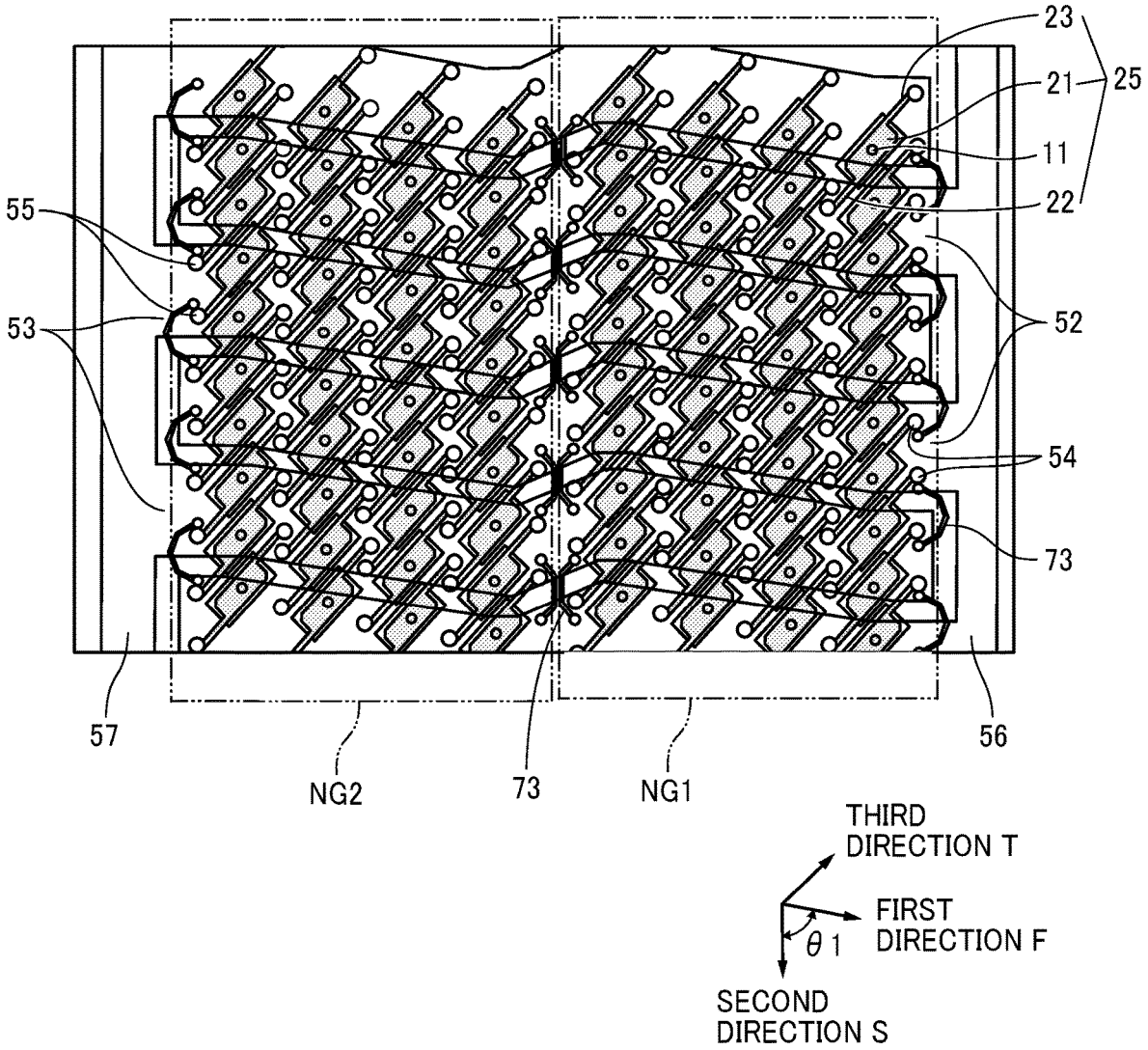
FIG. 7 is a plan view of the channels of the liquid discharge head in the first embodiment.

FIG. 7 is a plan view of the channels of the liquid discharge head.

Hereinafter, the "liquid discharge head 1" is simply referred to as the "head 1." The head 1 includes a nozzle plate 10, an individual-channel member 20 (channel plate), a diaphragm member 30, a common-channel member 50, a damper member 60, a frame 80, and a flexible wiring 101 (substrate) mounting a drive circuit 102 .

The nozzle plate 10 includes a plurality of nozzles 11 to discharge a liquid. As illustrated in FIG. 7, the plurality of nozzles 11 are arranged two-dimensionally in a matrix and are arranged side by side in three directions of a first direction F, a second direction S, and a third direction T.

The individual-channel member 20 includes a plurality of pressure chambers 21 (individual chambers) respectively communicating with the plurality of nozzles 11, a plurality of individual-supply channels 22 respectively communicating with the plurality of pressure chambers 21, and a plurality of individual-collection channels 23 respectively communicating with the plurality of pressure chambers 21. A combination of one pressure chamber 21, one individual-supply channel 22 communicating with one pressure chamber 21, and one individual-collection channel 23 communicating with one pressure chamber 21 is collectively referred to as an individual chamber 25.

The diaphragm member 30 forms a diaphragm 31 serving as a deformable wall of the pressure chamber 21, and the piezoelectric element 40 is formed on the diaphragm 31 to form a single body. Further, the diaphragm member 30 includes a supply opening 32 communicating with the individual-supply channel 22 and a collection opening 33 communicating with the individual-collection channel 23. The piezoelectric element 40 is a pressure generator to deform the diaphragm 31 to pressurize the liquid in the pressure chamber 21.

Note that the individual-channel member 20 and the diaphragm member 30 are not limited to be separate members. For example, an identical member such as a Silicon on Insulator (SOI) substrate may be used to form the individual-channel member 20 and the diaphragm member 30 in a single body. That is, an SOI substrate formed by sequentially forming a silicon oxide film, a silicon layer, and a silicon oxide film on a silicon substrate is used. The silicon substrate on which the SOI substrate is formed is used to form the individual-channel member 20, and the silicon oxide film, the silicon layer, and the silicon oxide film are used to form diaphragm 31. In the above-described configuration, the layer structure of the silicon oxide film, the silicon layer, and the silicon oxide film in the SOI substrate forms the diaphragm member 30. As described above, the diaphragm member 30 includes a member made of the material that is film-formed on a surface of the individual-channel member 20.

The common-channel member 50 includes a plurality of common-supply branch channels 52 that communicate with two or more individual-supply channels 22 and a plurality of common-collection branch channels 53 that communicate with two or more individual-collection channels 23 as illustrated in FIG. 5. The plurality of common-supply branch channels 52 and the plurality of common-collection branch channels 53 are arranged alternately adjacent to each other in the second direction S of the nozzles 11.

As illustrated in FIGS. 5 and 6, the common-channel member 50 includes a through hole serving as a supply port 54 that connects the supply opening 32 of the individual-supply channel 22 and the common-supply branch channel 52, and a through hole serving as a collection port 55 that connects the collection opening 33 of the individual-collection channel 23 and the common-collection branch channel 53.

The common-channel member 50 includes one or more common-supply main channels 56 (see FIGS. 3 and 4) that communicate with the plurality of common-supply branch channels 52, and one or more common-collection main channels 57 (see FIGS. 3 and 4) that communicate with the plurality of common-collection branch channels 53. Further, the common-supply main channel 56 communicates with a supply port 81 in the frame 80. Further, the common-collection main channel 57 communicates with a collection port 82 in the frame 80.

As illustrated in FIGS. 5 and 6, the damper member 60 includes a supply-side damper 62 that faces (opposes) the supply port 54 of the common-supply branch channel 52 and a collection-side damper 63 that faces (opposes) the collection port 55 of the common-collection branch channel 53.

The head 1 includes a plurality of collection-side dampers 63. The plurality of collection-side dampers 63 forms part of walls of the plurality of common-collection branch channels 53, respectively.

Thus, an identical damper member 60 forms the plurality of supply-side dampers 62 and the plurality of collection-side dampers 63, and each of the plurality of common-supply branch channels 52 and the plurality of common-collection branch channels 53 is formed of the identical damper member 60 that seals grooves formed on an identical common-channel member 50.

The plurality of collection-side dampers 63 faces the plurality of the collection ports 55, respectively.

As illustrated in FIGS. 5 and 6, the supply-side damper 62 and the collection-side damper 63 of the damper member 60 seal grooves in the common-channel member 50 to form the common-supply branch channel 52 and the common-collection branch channel 53.

The grooves are alternately arranged in the common-channel member 50 in a longitudinal direction of the common-supply main channel 56. Both of the common-supply branch channel 52 and the common-collection branch channel 53 are formed in the same common-channel member 50. As a material of the damper member 60, it is preferable to use a metal thin film or an inorganic thin film resistant to an organic solvent. A thickness of the supply-side damper 62 and the collection-side damper 63 of the damper member 60 is preferably 10 μm or less.

Next, a configuration of a channel arrangement according to the present embodiment is described below with reference to FIGS. 8 to 11. FIGS. 8 to 11 are enlarged schematic plan views of a main part of the channel arrangement of FIG. 7. In FIGS. 8 to 11, branch channels such as the common-supply branch channels 52 and the common-collection branch channels 53 are indicated by imaginary lines.

Figure 8:
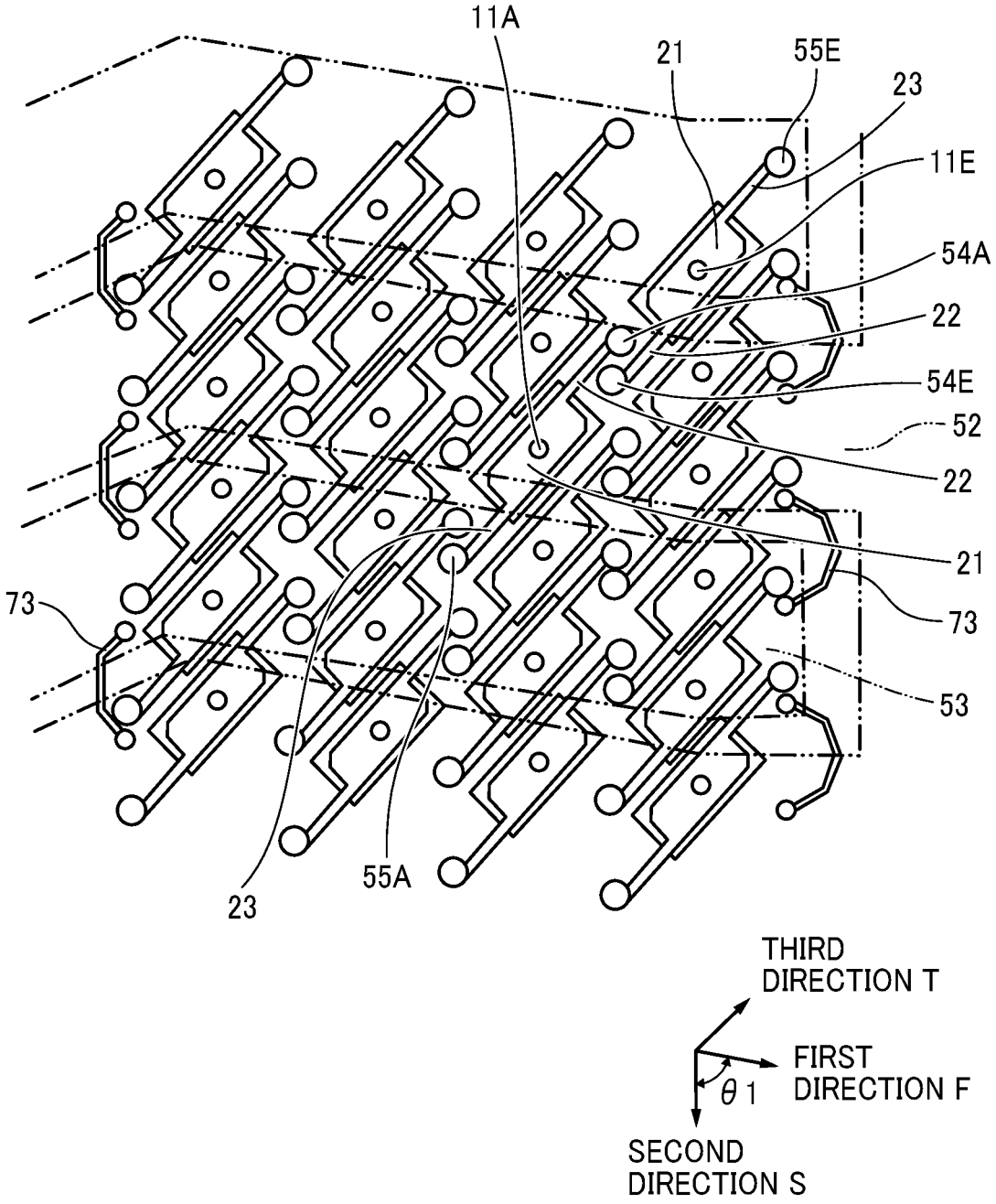
FIG. 8 is an enlarged plan view of a portion of the liquid discharge head in the first embodiment of FIG. 7.

As illustrated in FIG. 8, the plurality of nozzles 11 are arranged two-dimensionally in a matrix and are arranged side by side in three directions of a first direction F, a second direction S and a third direction T. As illustrated in FIG. 7, a group of the nozzles 11 arranged two-dimensionally in a matrix is defined as a nozzle group NG (NG1 and NG2). The common-supply branch channel 52 and the common-collection branch channel 53 are arranged in common across the two nozzle groups NG1 and NG2 (see FIG. 7).

In one nozzle group NG (NG 1 or NG 2, for example), the first direction F is a nozzle array direction along which the nozzles 11 are arranged (arrayed). The second direction S is a direction in which nozzle arrays are aligned at a predetermined inclination angle θ1 with the nozzle array direction the nozzles 11 (first direction F). Thus, the second direction S intersects the first direction F at an angle θ1. The common-supply branch channel 52 and the common-collection branch channel 53 extend in the first direction F (nozzle array direction). Therefore, a longitudinal direction of the common-supply branch channel 52 and the common-collection branch channel 53 is along the first direction F (nozzle array direction).

In one nozzle group NG (NG 1 or NG 2, for example), the second direction S is a direction (nozzle array direction) in which most adjacent nozzles 11 are arranged (arrayed) and is a direction intersecting the first direction F at an angle θ1 in the first direction F. The common-supply branch channel 52 and the common-collection branch channel 53 are alternately arranged in the second direction S.

In one nozzle group NG (NG 1 or NG 2, for example), the third direction T is a direction intersecting the first direction F and the second direction S. In the present disclosure, the individual chambers 25 configured by the individual-supply channel 22, the pressure chambers 21, and the individual-collection channels 23 is arranged along the third direction T.

The individual chamber 25 (see FIG. 7) configured by the individual-supply channel 22, the pressure chamber 21, and the individual-collection channel 25 has a shape of twice rotational symmetrical with an axis of the nozzle 11 (central axis in a direction of liquid discharge from the nozzle 11).

Thus, the head 1 in an example illustrated in FIG. 8 can be arranged such that the individual chamber 25 is arranged reversal to a first nozzle 11A and a nozzle 11E adjacent in a direction (third direction T) parallel to a direction of liquid flow in the individual chamber 25 as in a relation between the individual chamber 25 communicating with the first nozzle 11A and the individual chamber 25 communicating with the nozzle 11E, for example.

The first supply port 54A communicating with the individual chamber 25 of the first nozzle 11A and the supply port 54E communicating with the individual chamber 25 of the nozzle 11E are arranged in the identical common-supply branch channel 52. Further, a direction of arrangement of the individual chamber 25 communicating with the first supply port 54A can be arranged opposite (reversal) to a direction of arrangement of the individual chamber 25 communicating with the supply port 54E.

Thus, a package density of the individual chambers 25 (nozzles 11) can be increased without being restricted by an arrangement of the common-supply branch channel 52, and the head 1 thus can be downsized.

Further, in the example illustrated in FIG. 8, the first nozzle 11A connected to the first supply port 54A and the nozzle 11E connected to the supply port 54E communicate with different common-collection branch channels 53 through collection ports 55A and 55E, respectively. Thus, two nozzles 11 communicating with two supply ports 54 arranged nearest to each other (closest to each other) and arranged in the identical common-supply branch channel 52 communicate with different common-collection branch channels 53 via two collection ports 55, respectively.

The individual chambers 25 are translationally symmetrical (not reversely arranged) in the first direction F along which the liquid flows in the common-supply branch channel 52 and the common-collection branch channel 53.

Figure 9:
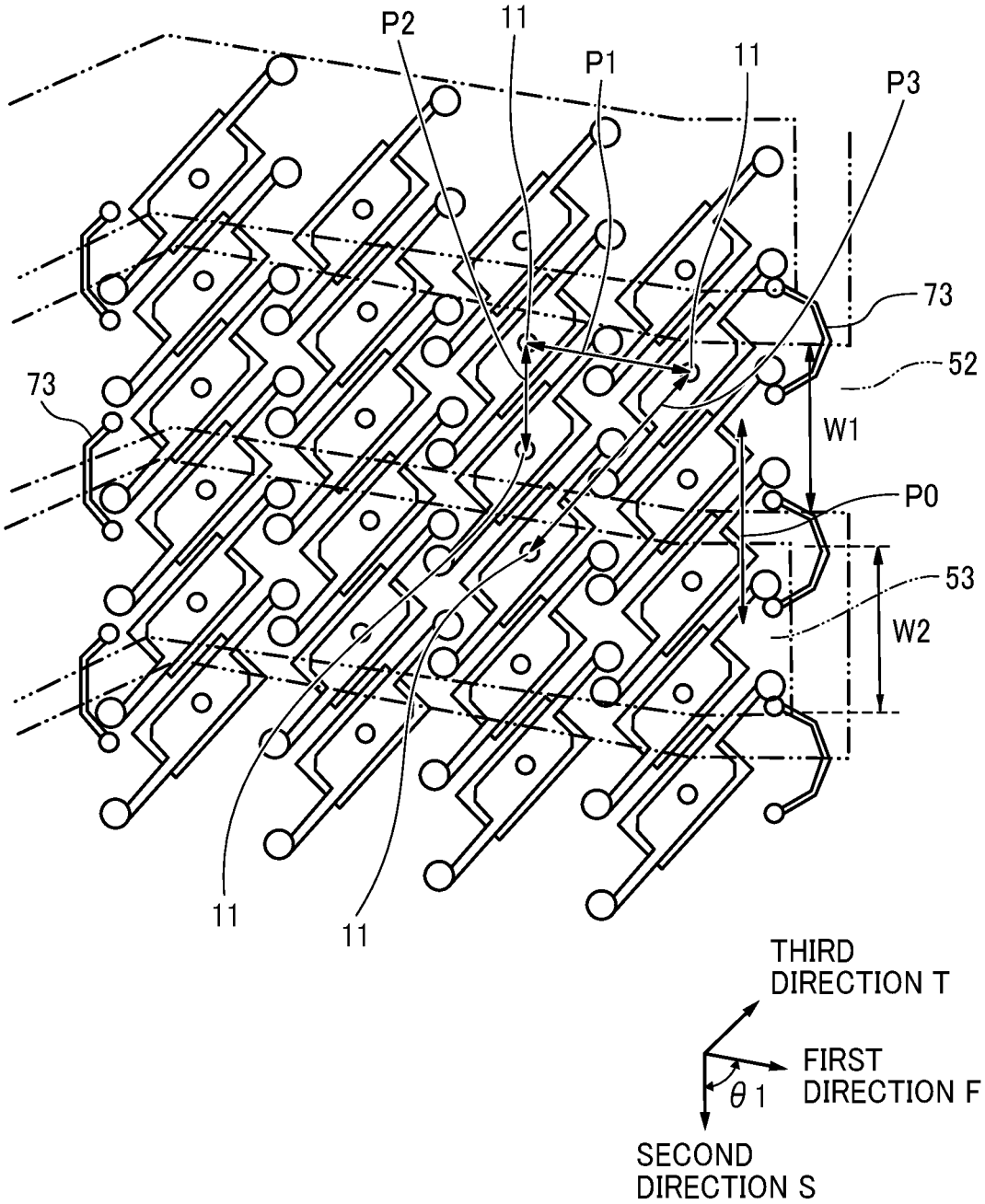
FIG. 9 is an enlarged plan view of a portion of the liquid discharge head in the first embodiment of FIG. 7.

As illustrated in FIG. 9, an interval P3 between the nozzles 11 adjacent in the third direction T can be set in an arbitrary direction. However, the interval P3 can be set wider than an interval P1 between the nozzles 11 adjacent in the first direction F and an interval P2 between the nozzles 11 adjacent in the second direction T.

The third direction T is set such that the interval P3 between the nozzles 11 adjacent in the third direction T has a distance equal to or more than twice the interval P2 between the nozzles 11 adjacent in the second direction S. Further, an interval P0 between the common-supply branch channel 52 and the common-collection branch channel 53 is set to be twice or more of the interval P2 of the nozzles 11 adjacent in the second direction S.

The interval P0 corresponds to a center distance between a width of channels in a direction along which the common-supply branch channel 52 and the common-collection branch channel 53 are alternately arranged (second direction S).

Further, a width W1 of the common-supply branch channel 52 is made wider (twice or more) of the interval P2 between the nozzles 11 adjacent in the second direction S. Similarly, a width W2 of the common-collection branch channel 53 is also made wider (twice or more) than the interval P2 between the nozzles 11 adjacent in the second direction S.

A relation between a distance "a" and a distance "b" is described below with reference to FIG. 10. The distance "a" is between the supply ports 54 of two most adjacent nozzles 11 among the nozzles 11 communicating with the identical common-supply branch channel 52. The distance "b" is between the supply port 54 to a supply-side damper 62 (see FIG. 6).

Figure 10:
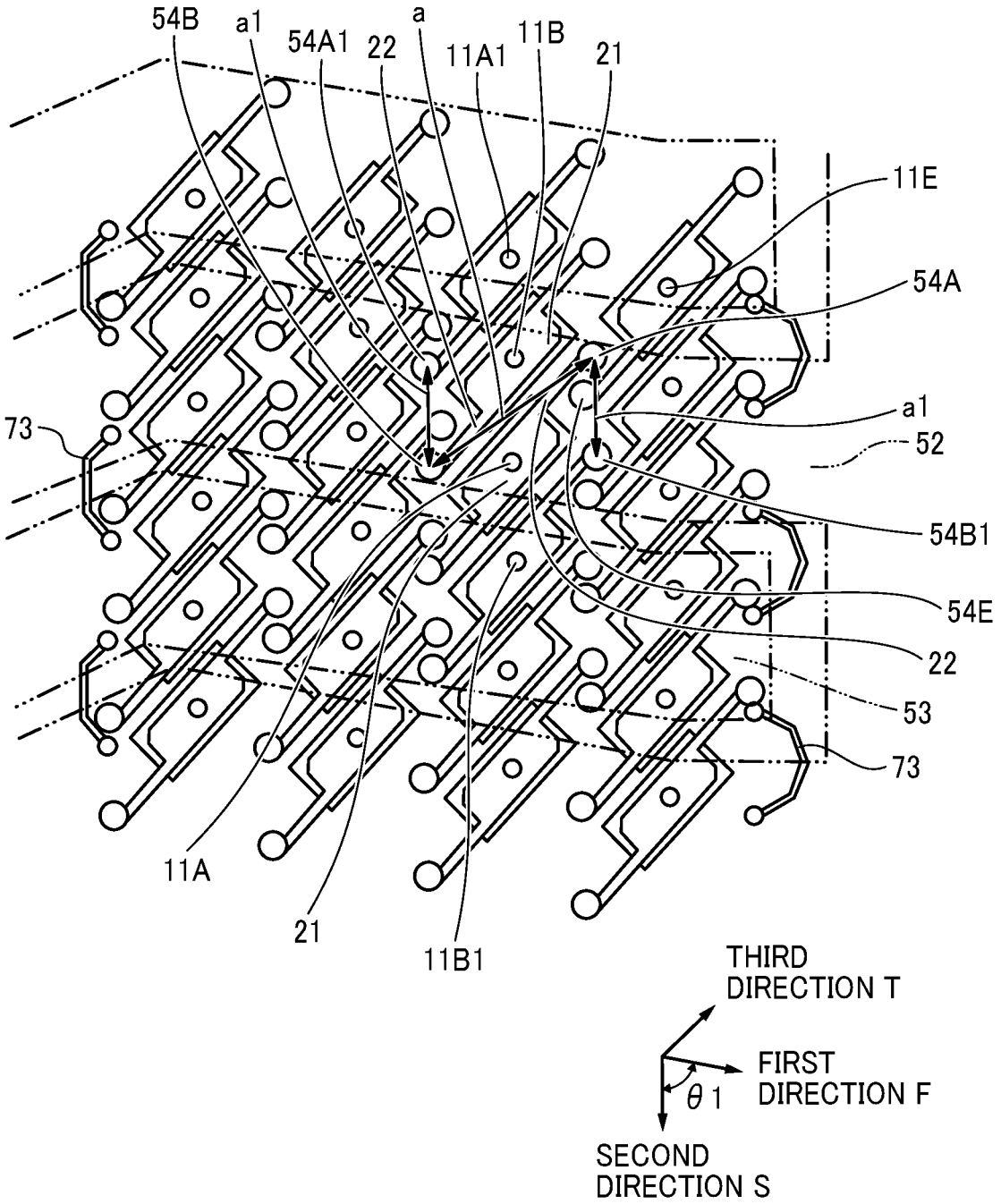
FIG. 10 is an enlarged plan view of a portion of the liquid discharge head in the first embodiment of FIG. 7.

Here, a first nozzle 11A and a second nozzle 11B in FIG. 10 are respectively selected as a combination of the most adjacent nozzles 11 among two adjacent nozzles 11. In FIG.

8, the nozzles 11 arranged in the second direction S are combinations of the most adjacent nozzles 11 in the same nozzle array (the nozzles 11 arrayed in the second direction S).

The supply port 54 communicating with the first nozzle 11A is referred to as a "first supply port 54A", and the supply port 54 communicating with the second nozzle 11B is referred to as a "second supply port 54B". The first supply port 54A communicating with the first nozzle 11A and the second supply port 54B communicating with the second nozzle 11B are arranged in the identical common-supply branch channel 52.

The distance "a" between the first supply port 54A and the second supply port 54B is greater than the distance "b" (see FIG. 6) between the supply port 54 (the first supply port 54A or the second supply port 54B) and the supply-side damper 62. Thus, the head 1 has a configuration that satisfies a relation of a>b.

The plurality of supply ports 54 further includes a third supply port 54B1, and the third supply port 54B1 is arranged in the identical one of the plurality of common-supply branch channels 52 with the first supply port 54A and the second supply port 54B. The third supply port 54B1 and one of the first supply port 54A and the second supply port 54B (first supply port 54A in FIG. 10) are spaced apart by a distance "a1" shorter than the distance "a" between the first supply port 54A and the second supply port 54B.

Further, in the head 1 according to an embodiment of the present disclosure, the first nozzle 11A is the most adjacent nozzle to a second nozzle 11B1 in the second direction S. The second nozzle 11B1 is arranged opposite to the second nozzle 11B via the first nozzle 11A in the second direction S. Therefore, a distance "a1" between the first supply port 54A communicating with the first nozzle 11A and a third supply port 54B1 communicating with the second nozzle 11B1 is also greater than the distance "b" from the supply port 54 to the supply-side damper 62. Thus, the head 1 has a configuration that satisfies a relation of a1>b.

Thus, the head 1 includes a plurality of supply-side dampers 62, and the plurality of supply-side dampers 62 forms a part of a wall of the plurality of common-supply branch channels 52, respectively.

The plurality of nozzles 11 includes a first nozzle 11A and a second nozzle 11B disposed closest to the first nozzle 11A (see FIG. 10).

The plurality of supply ports 54 includes a first supply port 54A communicating with the first nozzle 11A and a second supply port 54B communicating with the second nozzle 11B.

The first supply port 54A and the second supply port 54B are in an identical one of the plurality of common-supply branch channels 52, and the first supply port 54A and the second supply port 54B are spaced apart by a distance greater than a distance between one of the first supply port 54A and the second supply port 54B and one of the plurality of supply-side dampers 62 facing the one of the first supply port 54A and the second supply port 54B.

Similarly, in the head 1 according to an embodiment of the present disclosure, the second nozzle 11B is the most adjacent nozzle to a first nozzle 11A1 in the second direction S. The first nozzle 11A1 is arranged opposite to the first nozzle 11A via the second nozzle B in the second direction S. Thus, the distance "a1" between the first supply port 54A1 communicating with the first nozzle 11A1 and the second supply port 54B communicating with the second nozzle 11B is also greater than the distance "b" from the supply port 54 to the supply-side damper 62. Thus, the head 1 has a configuration that satisfies the relation of a1>b.

In the above-described case, the first supply port 54A and the second supply port 54B are not the most adjacent supply port 54. However, the first nozzle 11A and the second nozzle 11B are the most adjacent nozzles belonging to the same nozzle array (the nozzles 11 belong to the same nozzle array arrayed in the second direciton S).

The supply port 54E communicating with the nozzle 11E is the most adjacent to the first supply port 54A communicating with the first nozzle 11A as described above. The nozzle 11E is arranged in a different nozzle array from the first nozzle 11A and the second nozzle 11B.

In the head 1 with such a configuration, when the liquid in the pressure chamber 21 is pressurized and liquid is discharged from the nozzle 11, a pressure wave propagates from the individual-supply channel 22 to the common-supply branch channel 52 through the first supply port 54A.

The distance "b" from the supply port 54 to the supply-side damper 62 is short. Thus, the pressure wave coming out from the first supply port 54A spreads in a spherical shape, reaches to the supply-side damper 62, and is absorbed by the supply-side damper 62 before the pressure wave propagates and reaches to the second supply port 54B. Thus, the pressure wave reaching the second supply port 54B decreases.

Thus, the head 1 can reduce an interference (mutual interference) of pressure to other nozzles 11 through the common-supply branch channel 52 and thus can reduce the crosstalk.

On the other hand, the supply port 54E of the nozzle 11E is the most adjacent supply port 54 to the first supply port 54A. The pressure wave generated by the discharge operation of the liquid from the first nozzle 11A propagates through the supply port 54E and reaches to the pressure chamber 21 of the nozzle 11E. However, the nozzle 11E is arranged in a different array with the first nozzle 11A and is not driven simultaneously with the first nozzle 11A. Thus, the influence of crosstalk is reduced.

Arranging a structure of the channels as illustrated in FIG. 7 (FIGS. 8 to 11) can increase the density of nozzles 11 and reduce the crosstalk.

That is, in general, it is preferable to arrange the supply ports 54 such that a distance between all the supply ports 54 to be larger than the distance "b" between the supply port 54 and the supply-side damper 62 so that the crosstalk between adjacent nozzles 11 can be reduced.

However, increasing a distance between the supply ports 54 reduces the density of arrangement of the nozzles 11 and thus resulting in an increase in a size of the head 1.

Thus, adopting the above-described arrangement of the channels (nozzles 11) can increase a package density of the individual chambers 25 and reduce the size of the head 1.

The distance "b" from the supply port 54 to the supply-side damper 62 is preferably as short as possible. Thus, the distance "b" is set to be the optimum size in consideration of a cross-sectional area of the common-supply branch channel 52. In the above-described case, the common-supply branch channel 52 needs to secure a flow rate of the liquid for a number of the nozzles 11 connected to the common-supply branch channel 52 to distribute the liquid to each supply ports 54 connected to the same common-supply branch channel 52.

The distance b from the supply port 54 to the supply-side damper 62 corresponds to a channel height of the common-supply branch channel 52. Shortening the distance b between the supply port 54 and the supply-side damper 62 reduces the channel height of the common-supply branch channel 52. Further, shortening the distance "b" reduces a cross-sectional area of the common-supply branch channel 52 and increases a fluid resistance of the common-supply branch channel 52.

When the fluid resistance of the common-supply branch channel 52 is large, a fluctuation of a pressure loss in the common-supply branch channel 52 increases with a fluctuation of a flow rate at each nozzle 11 by the liquid discharge. The pressure loss depends on a product of a fluid resistance and a flow rate. When the fluctuation of the pressure loss increases, the pressure at each nozzles 11 fluctuates according to the flow rate at each nozzle 11. Thus, discharge characteristics of the liquid vary at each nozzle 11.

Thus, the head 1 in the present embodiment has a channel arrangement in which the width W1 of one common-supply branch channel 52 is made twice or more of the interval P2 of the nozzles 11 in the second direction S. Thus, the head 1 increases the cross-sectional area and reduces the fluid resistance of the common-supply branch channel 52.

Thus, the head 1 according to the present embodiment can reduce a fluid resistance and reduce the crosstalk at the same time.

Further, widening the width W1 of the common-supply branch channel 52 increases the width of the supply-side damper 62 and also increases a compliance of the supply-side damper 62. Therefore, it is preferable to sufficiently reduce the channel height of the common-supply branch channel 52 and increase the width of the common-supply branch channel 52 within an allowable range of the fluid resistance of the common-supply branch channel 52 so that the variation in discharge characteristics and crosstalk can be reduced.

Figure 11:
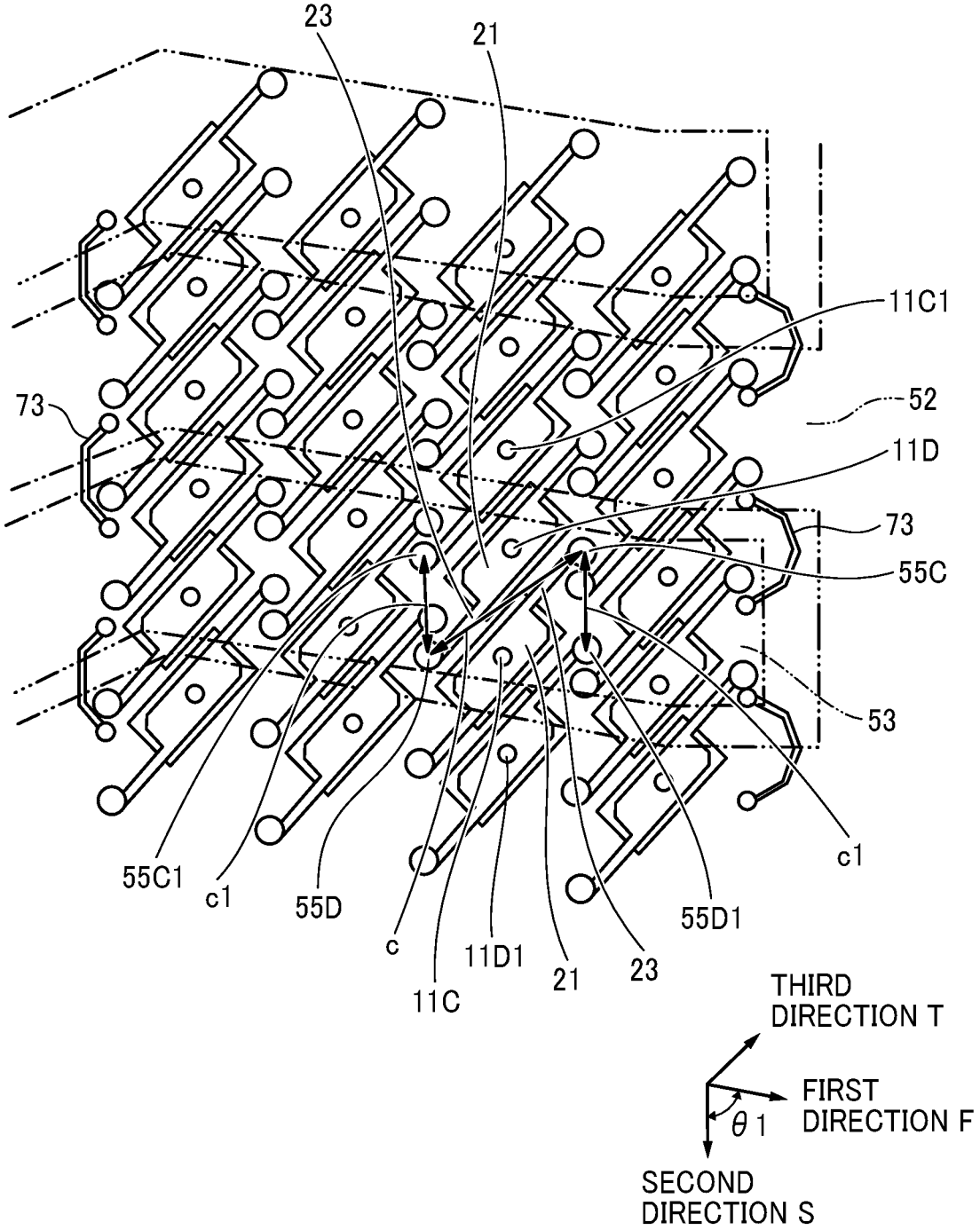
FIG. 11 is an enlarged plan view of a portion of the liquid discharge head in the first embodiment of FIG. 7.

Next, as illustrated in FIGS. 8 and 11, the head 1 according to the present embodiment has a configuration of a channel arrangement in which the individual-collection channel 23 is arranged opposite to the individual-supply channel 22 via the pressure chamber 21. Further, the individual-collection channel 23 is connected to the common-collection branch channel 53 via the collection port 55, and the plurality of common-collection branch channels 53 communicate with the common-collection main channel 57 as illustrated in FIG. 4.

Thus, the head 1 according to the present embodiment configures a head including a circulation-type individual chamber (pressure chamber). Thus, a liquid with high drying property or a liquid with high sedimentation property can be used to the head 1.

As described above, the common-supply branch channel 52 and the common-collection branch channel 53 are alternately arranged. The head 1 includes a collection-side damper 63 that faces the collection port 55 on a wall of the common-collection branch channel 53 (see FIG. 6).

The pressure wave generated in the pressure chamber 21 at the time of liquid discharge interferes not only with nozzles 11 at a supply side but also with other nozzles 11 via the common-collection branch channel 53. Thus, similar to the common-supply branch channel 52, variations in the discharge characteristics due to the crosstalk may occur via the common-collection branch channel 53.

Thus, the collection-side damper 63 on the wall of the common-collection branch channel 53 can reduce crosstalk transmitted via the common-collection branch channel 53.

Similar to the channels at the supply side, a third nozzle 11C and a fourth nozzle 11D are respectively selected as a combination of the most adjacent nozzles 11 of the collection side among the two adjacent nozzles 11. In FIG. 11, the nozzles 11 arranged in the second direction S are combinations of the most adjacent nozzles 11 in the same nozzle array (the nozzles 11 arrayed in the second direction S).

The collection port 55 communicating with the third nozzle 11C is referred to as a "first collection port 55C," and the collection port 55 communicating with the fourth nozzle 11D is referred to as a "second collection port 55D." The first collection port 55C communicating with the third nozzle 11C and the second collection port 55D communicating with the fourth nozzle 11D are arranged in the identical common-collection branch channel 53.

A distance "c" between the first collection port 55C and the second collection port 55D is greater than a distance "d" (=b, see FIG. 6) between the collection port 55 (the first collection port 55C and the second collection port 55D) and the collection-side damper 63. Thus, the head 1 has a configuration that satisfies a relation of c>d.

Thus, the first collection port 55C and the second collection port 55D are spaced apart by a distance greater than a distance between one of the first collection port 55C and the second collection port 55D and one of the plurality of collection-side dampers 63 facing the one of the first collection port 55C and the second collection port 55D.

For example, the plurality of collection ports 55 further includes a third collection port 55D1, and the third collection port 55D1 is arranged in the identical one of the plurality of common-collection branch channels 52 with the first collection port 55C and the second collection port 55D. The third collection port 55D1 and one of the first collection port 55C and the second collection port 55D (first collection port 55C in FIG. 11) are spaced apart by a distance "c1" shorter than the distance "c" between the first collection port 55C and the second collection port 55D. The nozzle 11C communicating with the collection port 55C is arranged in a different array from the nozzle 11D1 communicating with the third collection port 55D1.

Further, in the present embodiment, the third nozzle 11C is the most adjacent nozzle to a fourth nozzle 11D1 in the second direction S. The fourth nozzle 11D1 is arranged opposite to the fourth nozzle 11D via the third nozzle 11C in the second direction S. Thus, the distance "c1" between the first collection port 55C communicating with the third nozzle 11C and the third collection port 55D1 communicating with the fourth nozzle 11D1 is also greater than the distance d (see FIG. 6) between the collection port 55 and the collection-side damper 63. Thus, the head 1 has a configuration that satisfies a relation of c1>d.

Further, in the present embodiment, the fourth nozzle 11D is the most adjacent nozzle to a third nozzle 11C1 in the second direction S. The third nozzle 11C1 is arranged opposite to the third nozzle 11C via the fourth nozzle 11D in the second direction S. Thus, the distance "c1" between the first collection port 55C1 communicating with the third nozzle 11C1 and a second collection port 55D communicating with the fourth nozzle 11D is also greater than the distance "d" (see FIG. 6) between the collection port 55 and the collection-side damper 63. Thus, the head 1 has a configuration that satisfies a relation of c1>d.

The first collection port 55C and the second collection port 55D are not the most adjacent collection port 55. However, the third nozzle 11C and the fourth nozzle 11D are the most adjacent nozzles belonging to the same nozzle array.

In the head 1 with such a configuration, when the liquid in the pressure chamber 21 is pressurized and discharged from the nozzle 11, a pressure wave propagates from the individual-collection channel 23 to the common-collection branch channel 53 through the first collection port 55C. The pressure wave coming out of the first collection port 55C arrives at the collection-side damper 63 and is absorbed and attenuated before propagating to the second collection port 55D.

Thus, the head 1 can reduce an interference (mutual interference) of pressure to other nozzles 11 through the common-collection branch channel 53 and thus can reduce the crosstalk.

Further, in the present embodiment, the common-supply branch channel 52 and the common-collection branch channel 53 are alternately arranged in the common channel member 50.

Thus, the head 1 can form the supply-side damper 62 of the common-supply branch channel 52 and the collection-side damper 63 of the common-collection branch channel 53 with one damper member 60. Thus, it is possible to reduce the size of the head 1.

Further, as illustrated in FIG. 9, an interval P0 between the common-supply branch channel 52 and the common-collection branch channel 53 is set to be twice or more of the interval P2 between the nozzles 11 adjacent in the second direction S. Similar to a width W1 of the common-supply branch channel 52, a width W2 of the common-collection branch channel 53 is also made wider (twice or more) of the interval P2 between the nozzles 11 in the second direction S.

Thus, also in the common-collection branch channel 53, the head 1 according to the present embodiment can increase a compliance of the collection-side damper 63 while reducing the fluid resistance and sufficiently shorten a distance between the collection-side damper 63 and the collection port 55.

Therefore, the head 1 can reduce the crosstalk due to propagation of the pressure wave. Thus, the head 1 can adopt to various types of liquids in the circulation-type head and improve the reliability of the head 1.

Thus, the head 1 having the arrangement of the channels as described in FIGS. 7 to 11 can reduce the fluid resistance of each of the common-supply branch channel 52 and the common-collection branch channel 53. Further, the head 1 can increase the compliance of the damper disposed in the common-supply branch channel 52 and the common-collection branch channel 53. Thus, the head 1 can reduce a fluid resistance and reduce the crosstalk at the same time to stably discharge the liquid.

Figure 12:
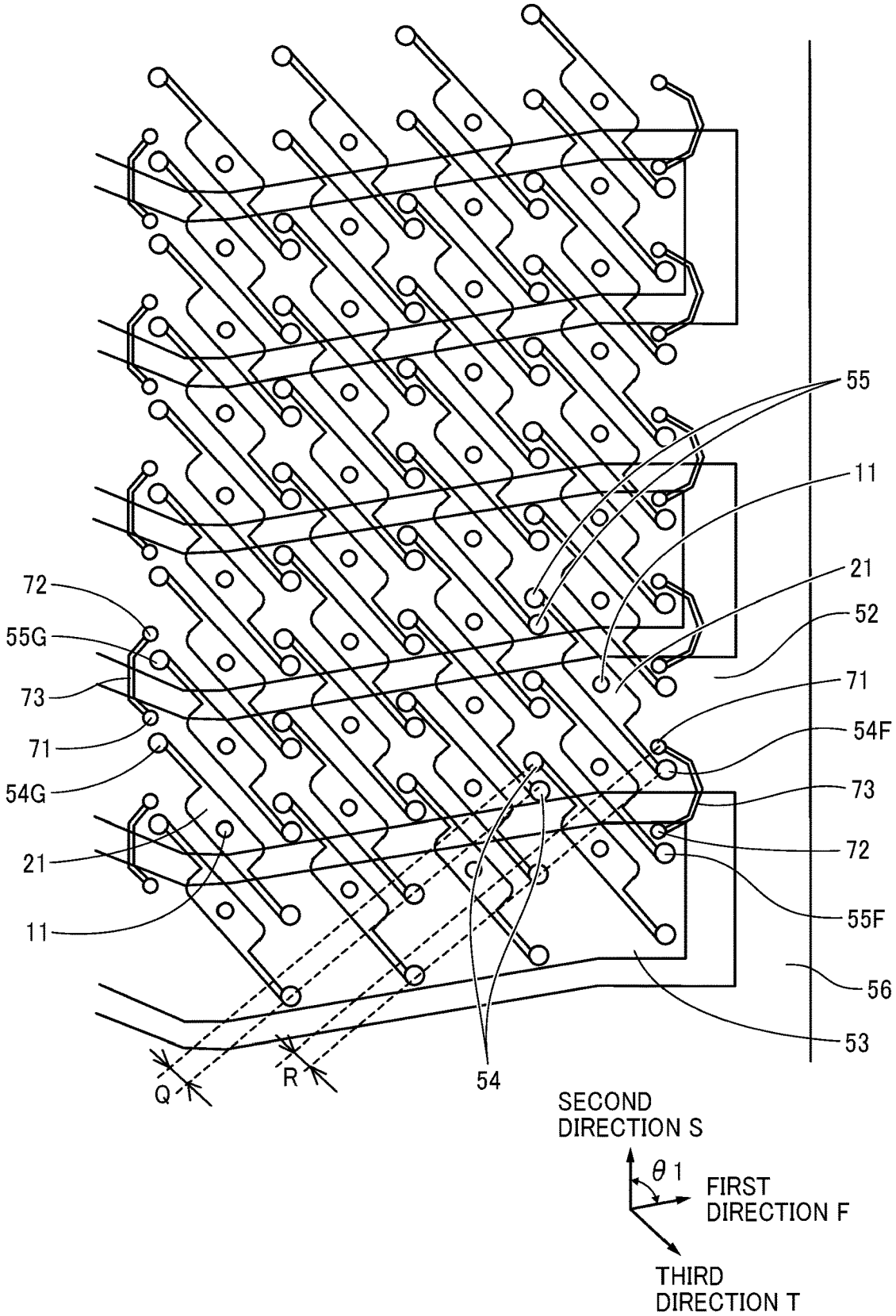
FIG. 12 is an enlarged plan view of a portion of one nozzle group to illustrate configuration of a bypass channel in the first embodiment.
Figure 13:
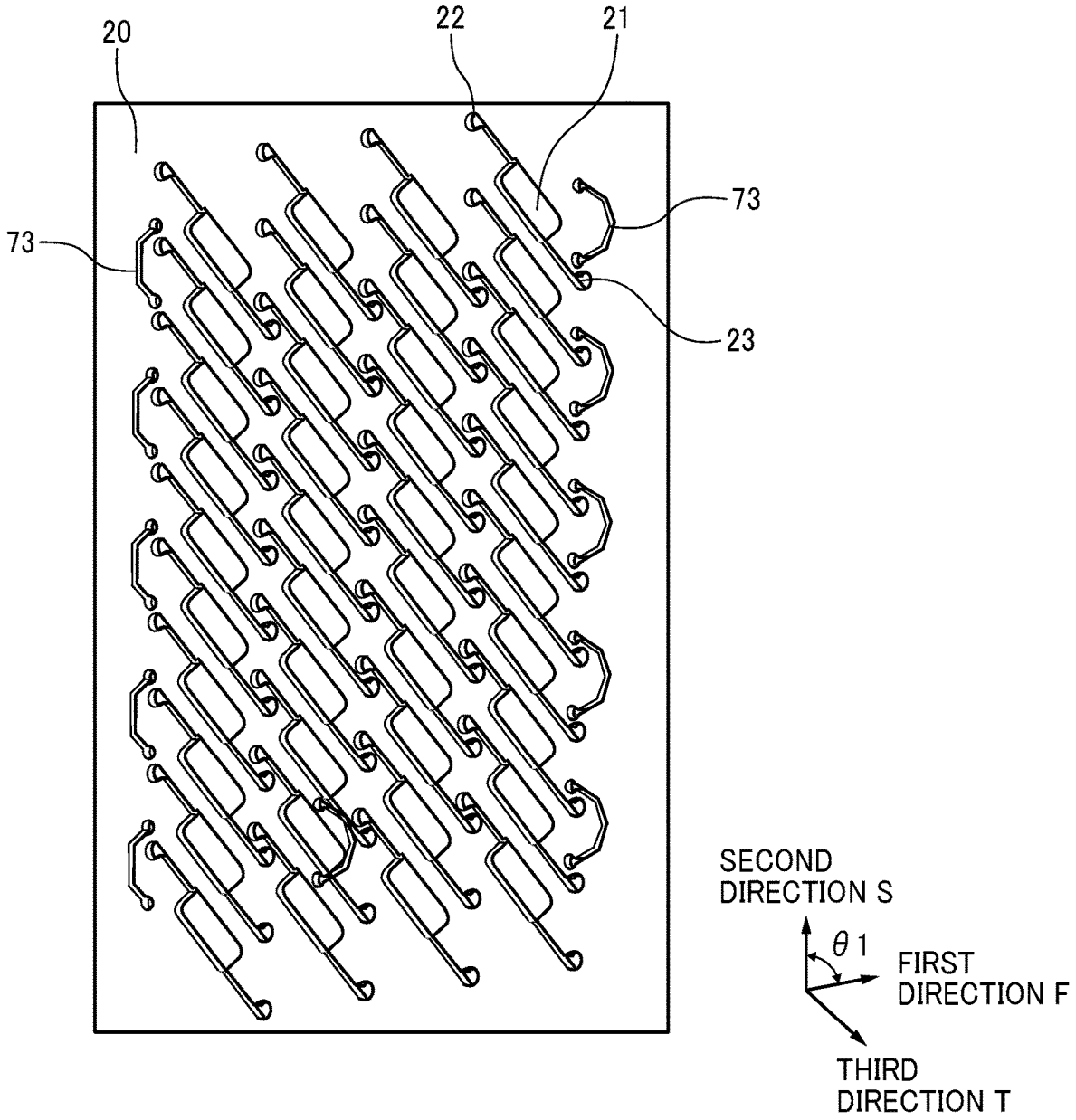
FIG. 13 is a schematic perspective view of a channel plate in which the bypass channel is formed.

Next, a configuration of a bypass channel in the present embodiment is described with reference to FIGS. 12 and 13. FIG. 12 is an enlarged plan view of a part of one nozzle group. FIG. 13 is a schematic perspective view of a channel plate in which the bypass channel is formed.

The head 1 in FIGS. 12 and 13 includes bypass supply ports 71 respectively adjacent to supply ports 54F arranged at both longitudinal ends of the common-supply branch channels 52 in the first direction F among the plurality of supply ports 54 communicating with the nozzles 11 in one nozzle group NG. For example, the bypass supply port 71 is provided to each end of the common-supply branch channel 52 in the first direction F, that is, each of a left end and a right end of the common-supply branch channel 52 in the first direction F in FIG. 12.

Further, the head 1 includes bypass collection ports 72 respectively adjacent to collection ports 55F arranged at both longitudinal ends of the common-collection branch channels 53 in a first direction F among the plurality of collection ports 55 communicating with the nozzles 11 in the one nozzle group NG.

Further, the head 1 includes a plurality of bypass channels 73 connecting the plurality of bypass supply ports 71 and the plurality of bypass collection ports 72, respectively. Thus, each of a plurality of bypass channels 73 connects the bypass supply port 71 and the bypass collection port 72. The bypass channel 73 is provided in an individual-channel member 20 (channel plate) in which pressure chambers 21 are formed as illustrated in FIG. 13. Thus, the bypass channel 73 communicates the common-supply branch channel 52 and the common-collection branch channel 53 at each longitudinal end of the common-supply branch channel 52 and the common-collection branch channel 53 (first direction F).

A distance (interval) R between the bypass supply port 71 and the supply port 54F adjacent to the bypass supply port 71 is substantially the same as a distance (interval) Q between the adjacent supply ports 54. Similarly, a distance (interval) between the bypass collection port 72 and the collection port 55F adjacent to the bypass collection port 72 is substantially the same as a distance (interval) between the adjacent collection ports 55. The distance (interval) Q between the adjacent supply ports 54 is a distance (interval) between the most adjacent supply ports 54.

In the head 1 according to the present embodiment, the supply ports 54F and 54G and the collection ports 55F and 55G are isolated without an adjacent supply port 54 and an adjacent collection port 55 compared to the supply ports 54 and the collection ports 55 near a center of the common-supply branch channel 52 and the common-collection branch channel 53 in the first direction F. The supply ports 54F and 54G and the collection ports 55F and 55G are arranged at both ends of the common-supply branch channel 52 and the common-collection branch channel 53 in the first direction F. Here, the first direction F is parallel to a longitudinal direction of the common-supply branch channel 52 and the common-collection branch channel 53 (hereinafter, simply referred to as the "longitudinal direction").

Thus, when the pressure generated in the pressure chamber 21 propagates to the common-supply branch channel 52 and the common-collection branch channel 53 during a liquid discharge operation, a pressure difference is generated between an end region and a center region of the common-supply branch channel 52 and the common-collection branch channel 53 in the longitudinal direction (first direction F), thus causing variations in discharge characteristics of the head 1.

In particular, when the liquid flows through the common-supply branch channel 52 and the common-collection branch channel 53 in the head 1 of flow-through type, the pressure in the common-supply branch channel 52 and the common-collection branch channel 53 changes in the longitudinal direction (first direction F) due to the pressure loss of the branch channels. Thus, the pressure difference between the end region and the center region increases.

Thus, in one nozzle group NG, the bypass supply port 71 is arranged adjacent to the supply port 54F at each longitudinal end (in the first direction F) of the common-supply branch channel 52 and the common-collection branch channel 53. Further, in one nozzle group NG, the bypass collection port 72 is arranged adjacent to the collection port 55F at each longitudinal end (in the first direction F) of the common-supply branch channel 52 and the common-collection branch channel 53. Thus, the head 1 includes the bypass channel 73 that connects the bypass supply port 71 and the bypass collection port 72 to connect the common-supply branch channel 52 and the common-collection branch channel 53 at each longitudinal end in the first direction F.

Thus, the head 1 can reduce the pressure difference between the common-supply branch channel 52 and the common-collection branch channel 53 at each longitudinal end and reduce the variation in the discharge characteristics in one nozzle group NG.

In FIG. 12, the bypass channel 73 is disposed adjacent to the pressure chamber 21 at each longitudinal end of the common-supply branch channel 52 and the common-collection branch channel 53. Thus, the head 1 including the bypass channel 73 can reduce the size of the head 1 as compared with the head 1 including a dummy pressure chamber and prevent an increase in a length of the branch channel such as the common-supply branch channel 52 and the common-collection branch channel 53.

A fluid resistance of a flow-through path from the supply port 54 to the collection port 55 via the pressure chamber 21 is made substantially the same as a fluid resistance of a flow-through path from the bypass supply port 71 to the bypass collection port 72 via the bypass channel 73. Specifically, the bypass channel 73 is shorter than a flow-through path including the pressure chamber 21, the individual-supply channel 22, and the individual-collection channel 23. Further, the bypass channel 73 has a width narrower than a width of the pressure chamber 21. Thus, the head 1 can further reduce the variation in the pressure difference.

The distance (interval) R between the bypass supply port 71 and the supply port 54 adjacent to the bypass supply port 71 is substantially the same as the distance (interval) Q between the adjacent supply ports 54. Thus, the head 1 can further reduce the variation in the pressure difference.

Figure 14:
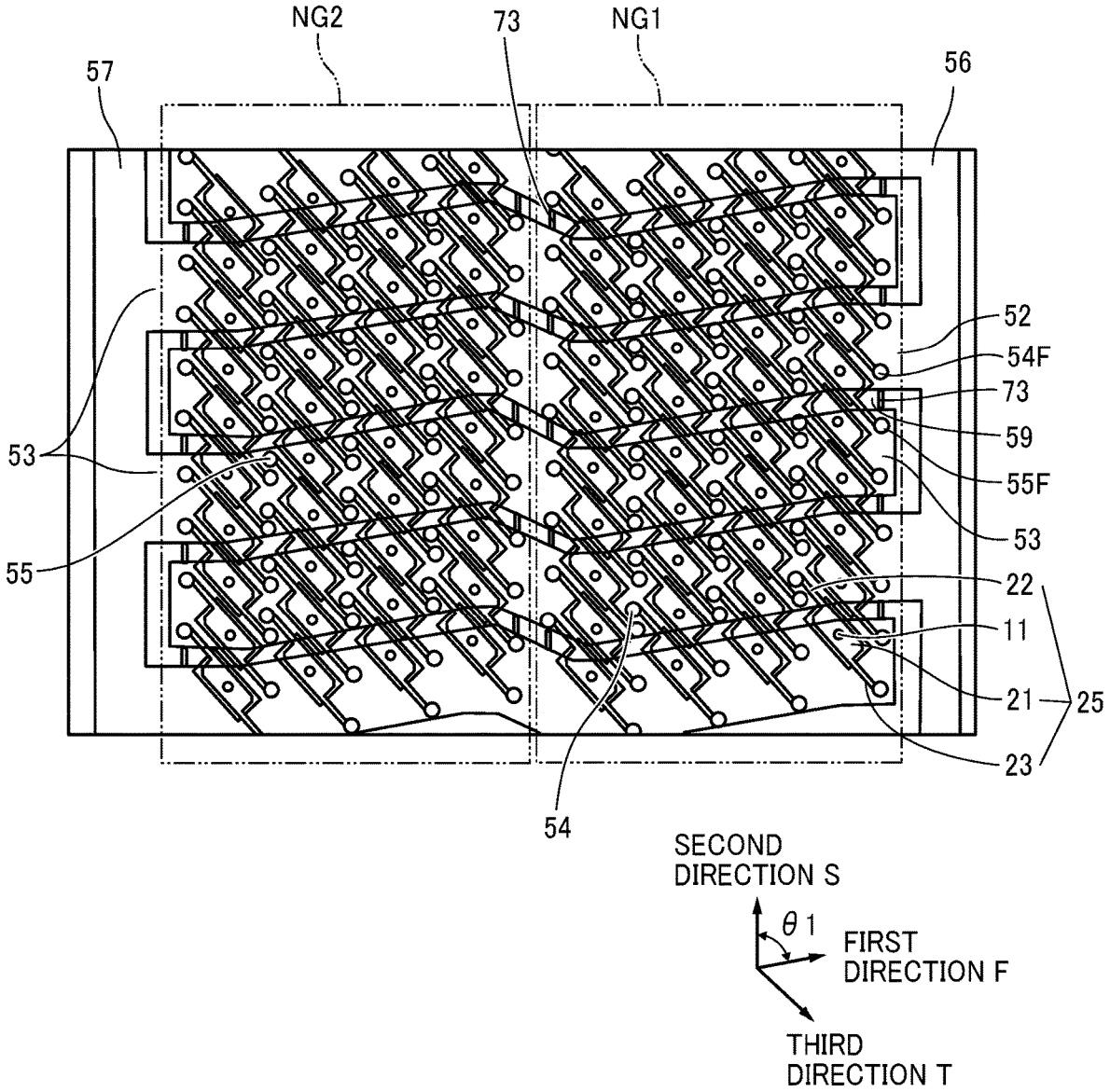
FIG. 14 is a plan view of channels of the liquid discharge head according to a second embodiment of the present disclosure.
Figure 15:
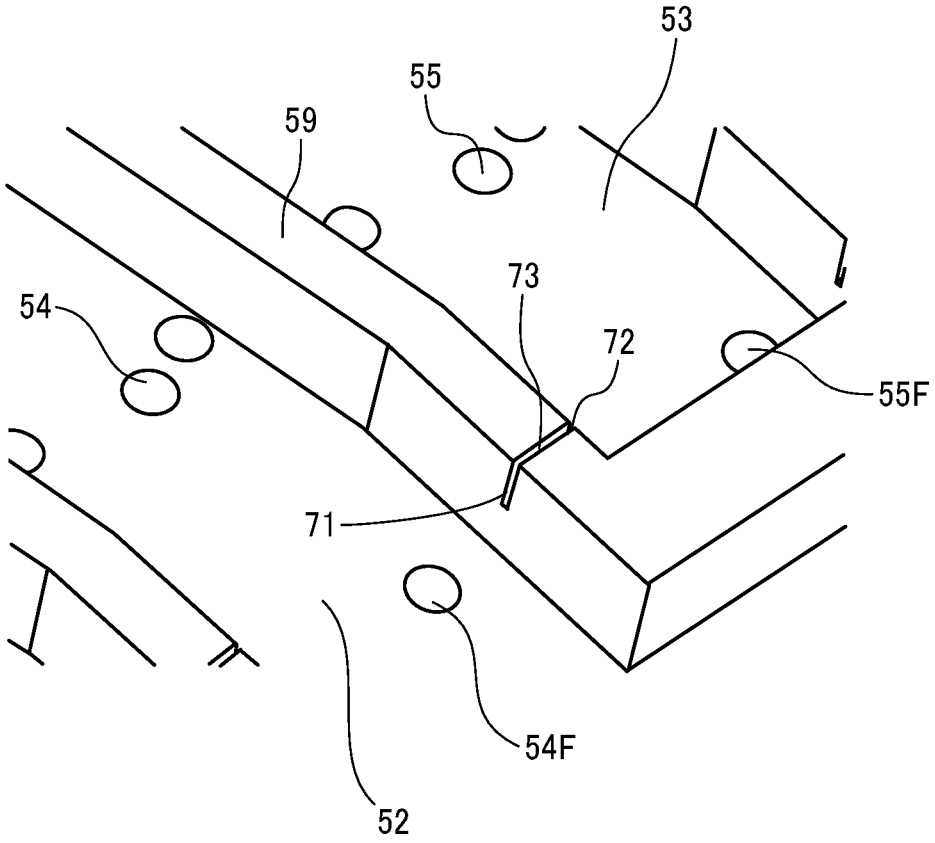
FIG. 15 is an enlarged perspective view of a portion of the liquid discharge head in the second embodiment.
Figure 16:
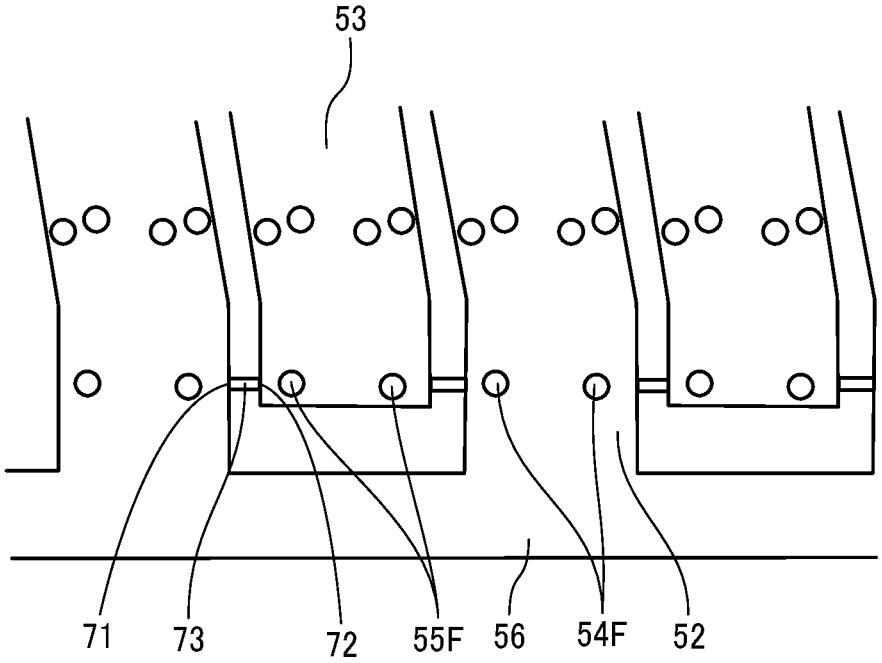
FIG. 16 is an enlarged plan view of a portion of the liquid discharge head in the second embodiment.

Next, the head 1 according to a second embodiment of the present disclosure is described with reference to FIGS. 14 to 16. FIG. 14 is a schematic plan view of the head 1 according to the second embodiment. FIG. 15 is an enlarged perspective view of a portion of the head 1. FIG. 16 is an enlarged plan view of a portion of the head 1.

The head 1 according to the second embodiment includes a bypass channel 73 at each longitudinal end (in the first direction F) of the common-supply branch channel 52 and the common-collection branch channel 53 in one nozzle group NG. The bypass channel 73 is a groove formed on a partition wall 59 between the common-supply branch channel 52 and the common-collection branch channel 53 adjacent to each other to connect the common-supply branch channel 52 and the common-collection branch channel 53.

An opening of the groove that forms the bypass channel 73 at the common-supply branch channel 52 side becomes the bypass supply port 71 adjacent to the supply port 54F arranged at each longitudinal end of the common-supply branch channel 52 in the first direction F. Another opening of the groove that forms the bypass channel 73 at the common-collection branch channel 53 side becomes the bypass collection port 72 adjacent to the collection port 55F arranged at each longitudinal end of the common-collection branch channel 53 in the first direction F.

As described above, the head 1 includes the bypass channel 73 in a partition wall 59 between the common-supply branch channel 52 and the common-collection branch channel 53. Thus, the head 1 has a simpler configuration, a smaller size, and a higher density.

Figure 17:
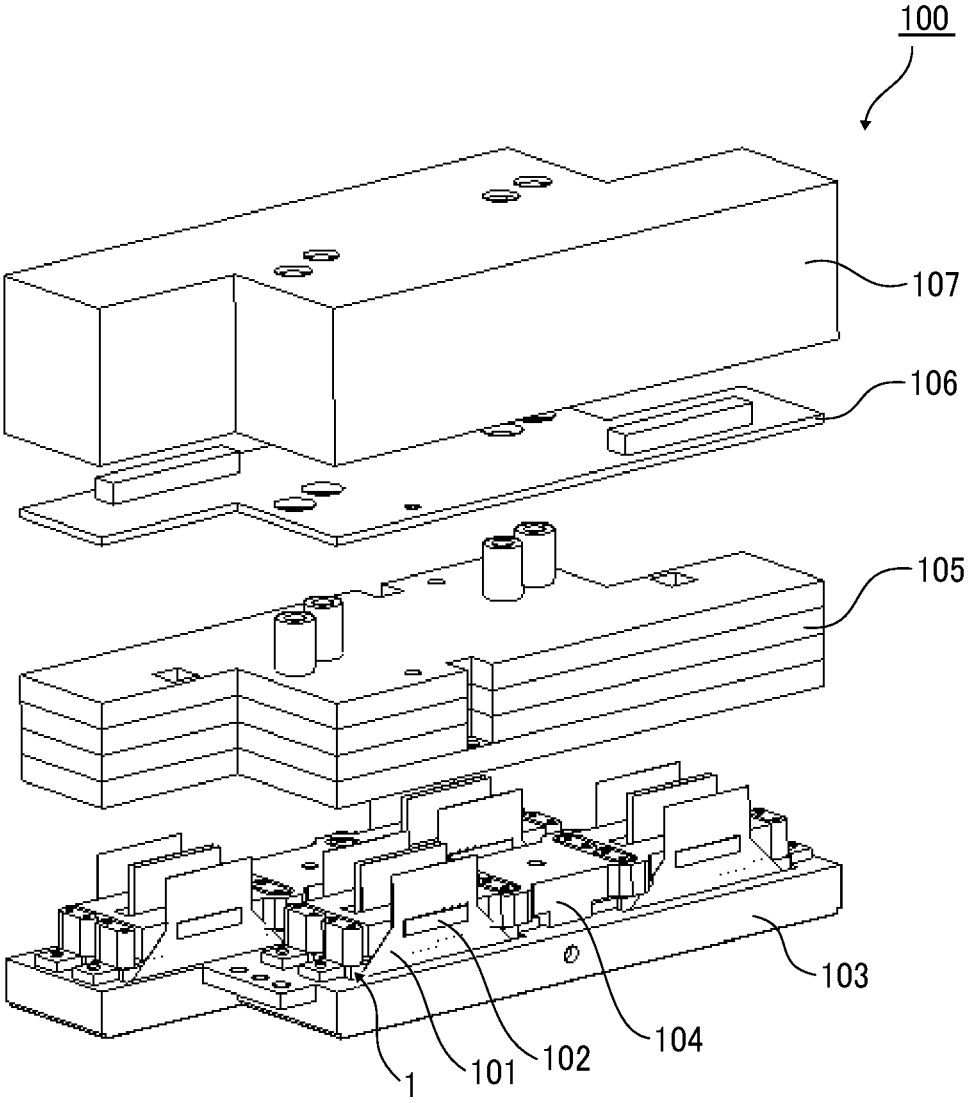
FIG. 17 is an exploded perspective view of a head module according to an embodiment of the present disclosure.
Figure 18:
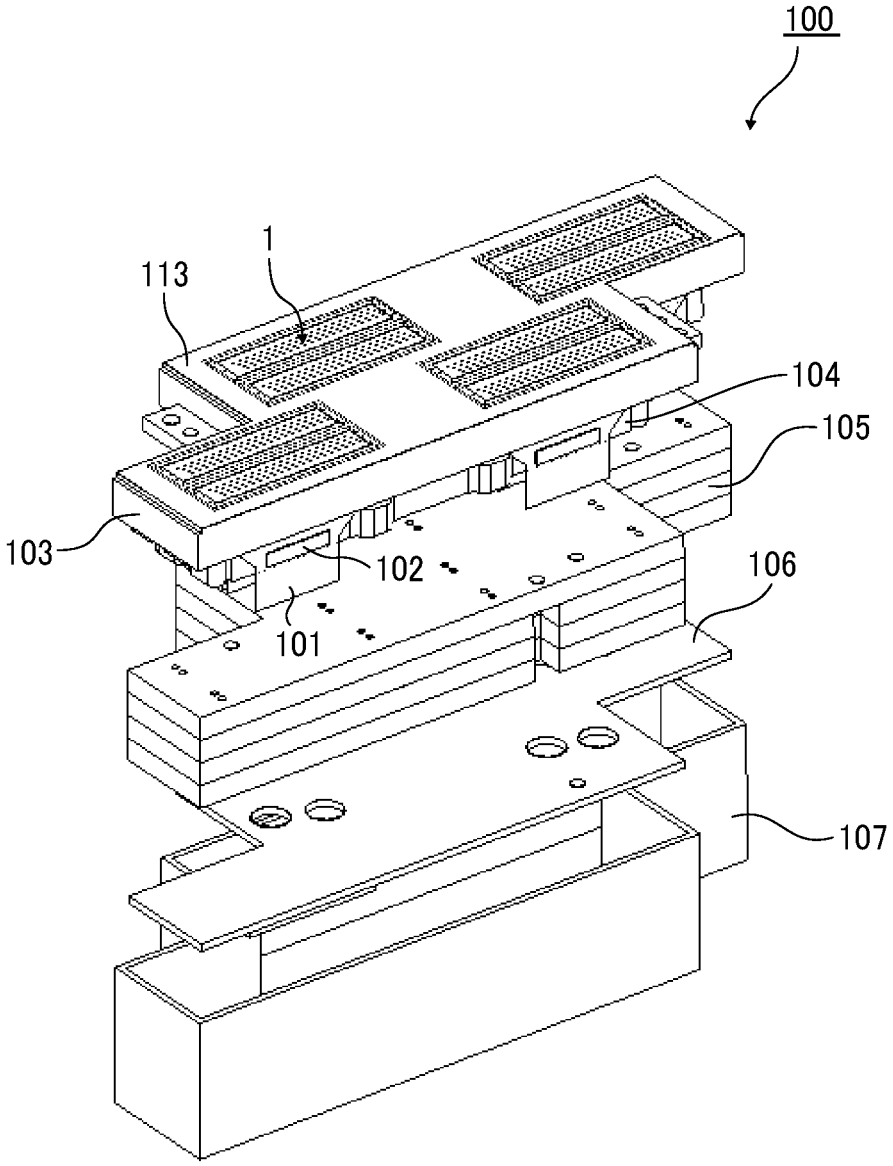
FIG. 18 is an exploded perspective view of the head module viewed from a nozzle surface side of the head module of FIG. 17.

FIGS. 17 and 18 illustrate an example of a head module according to an embodiment of the present disclosure. FIG. 17 is an exploded perspective view of the head module 100. FIG. 18 is an exploded perspective view of the head module 100 viewed from a nozzle surface side of the head module 100.

The head module 100 includes a plurality of heads 1 to discharge a liquid, a base 103 that holds the plurality of heads 1, and a cover 113 serving as a nozzle cover of the plurality of heads 1.

Thus, the head module 100 includes a plurality of heads 1 arrayed in one direction.

Further, the head module 100 includes a heat radiator 104, a manifold 105 forming a channel to supply liquid to the plurality of heads 1, a printed circuit board 106 (PCB) connected to a flexible wiring 101, and a module case 107.

Figure 19:
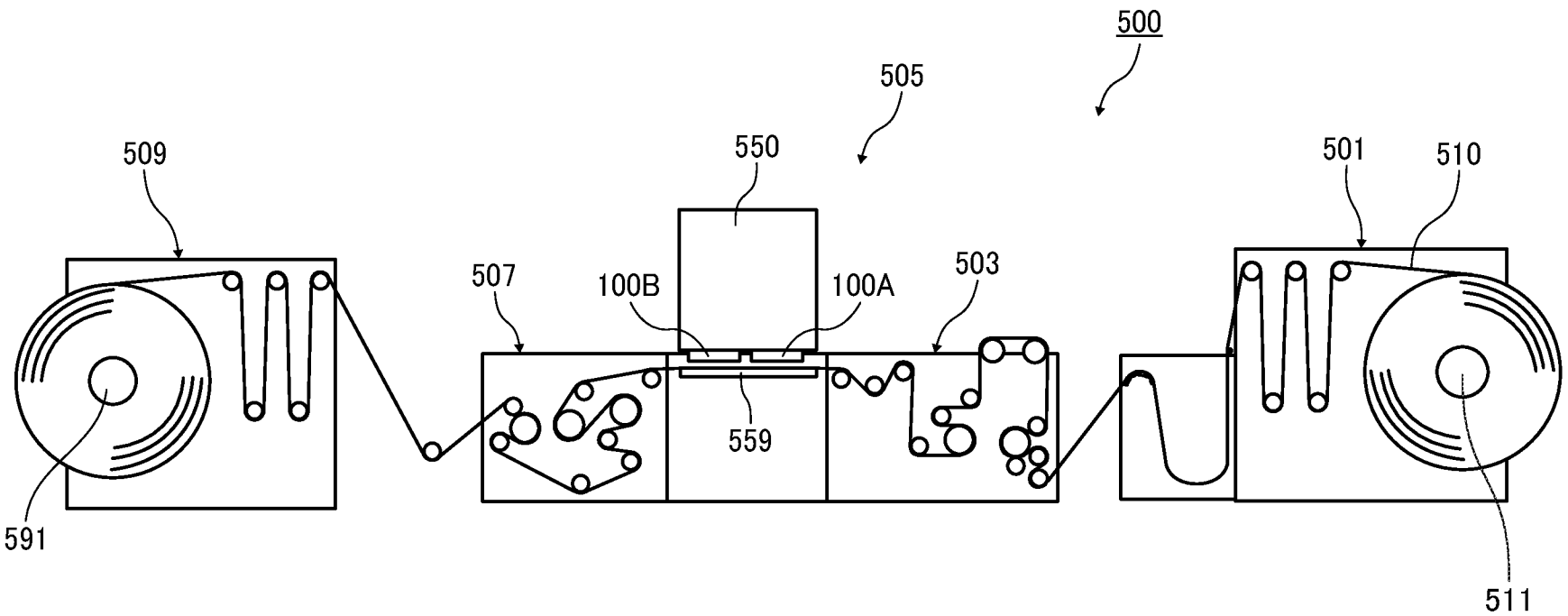
FIG. 19 is a schematic side view of a liquid discharge apparatus according to an embodiment of the present disclosure.
Figure 20:
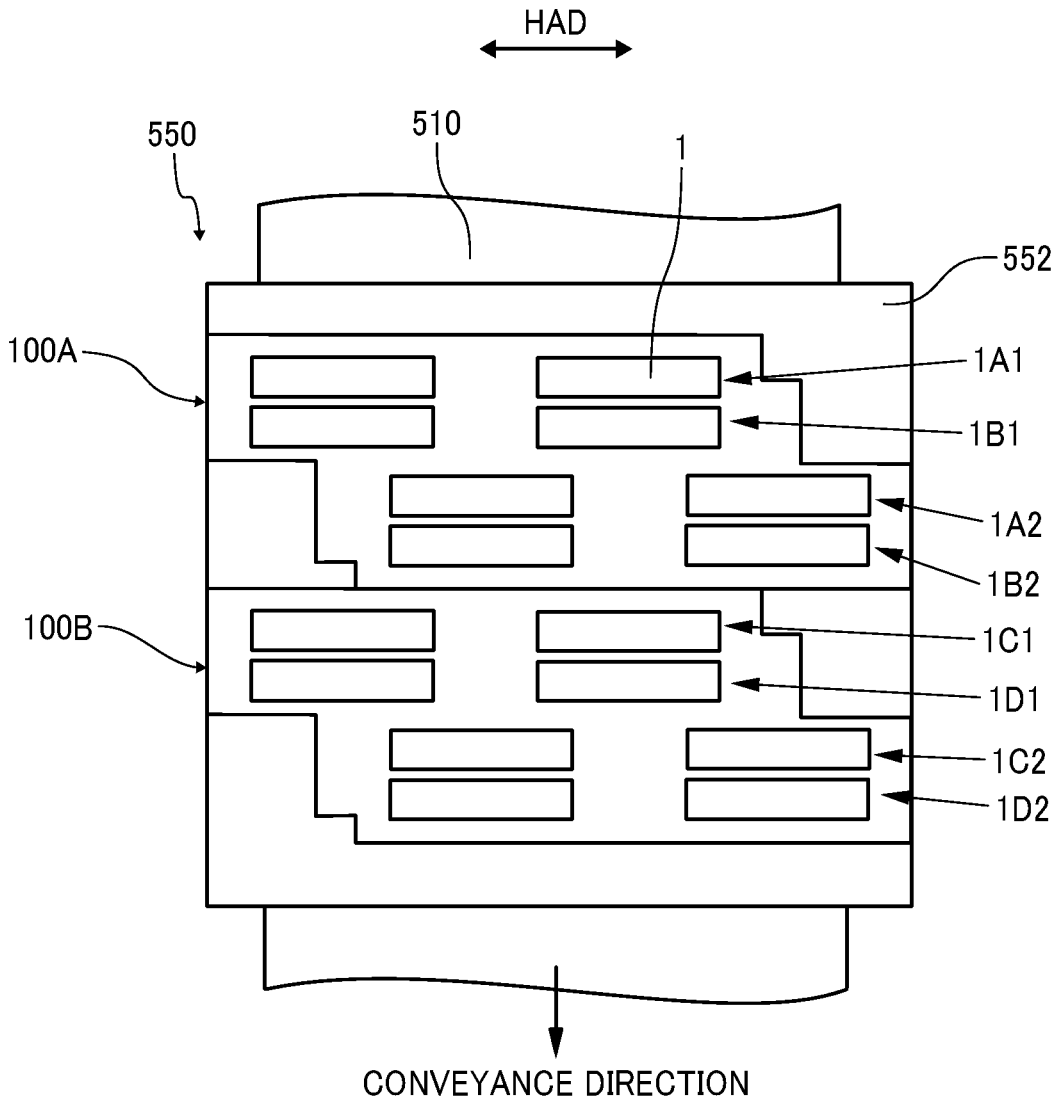
FIG. 20 is a plan view of an example of a head unit of the liquid discharge apparatus of FIG. 19.

FIGS. 19 and 20 illustrate an example of a liquid discharge apparatus according to an embodiment of the present disclosure. FIG. 19 is a side view of a liquid discharge apparatus according to an embodiment of the present disclosure. FIG. 20 is a plan view of a head unit of the liquid discharge apparatus of FIG. 19 according to the present embodiment.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge a liquid onto the continuous medium 510 to form an image on the continuous medium 510, a dryer 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the dryer 507, and the ejector 509, and wound around a take-up roller 591 of the ejector 509.

In the printing unit 505, the continuous medium 510 is conveyed opposite the head unit 550 on a conveyance guide 559. The head unit 550 discharges a liquid from the nozzles 11 of the head modules 100A and 100B to form an image on the continuous medium 510.

Here, in the head unit 550, two head modules 100A and 100B according to the present disclosure are provided in the common base member 552.

The head module 100A includes head arrays 1A1, 1B1, 1A2, and 1B2. Each of the head arrays 1A1, 1B1, 1A2, and 1B2 includes a plurality of heads 1 arranged in a direction perpendicular to a conveyance direction of the continuous medium 510. The direction perpendicular to the conveyance direction of the continuous medium 510 is also referred to as a "head array direction" indicated by arrow "HAD" in FIG. 23. The head module 100B includes head arrays 1C1, 1D1, 1C2, and 1D2.

Each of the head arrays 1C1, 1D1, 1C2, and 1D2 includes a plurality of heads 1 arranged in the head array direction HAD. The head 1 in each of the head arrays 1A1 and 1A2 of the head module 100A discharges liquid of the same color. Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquid of the same color.

Figure 21:
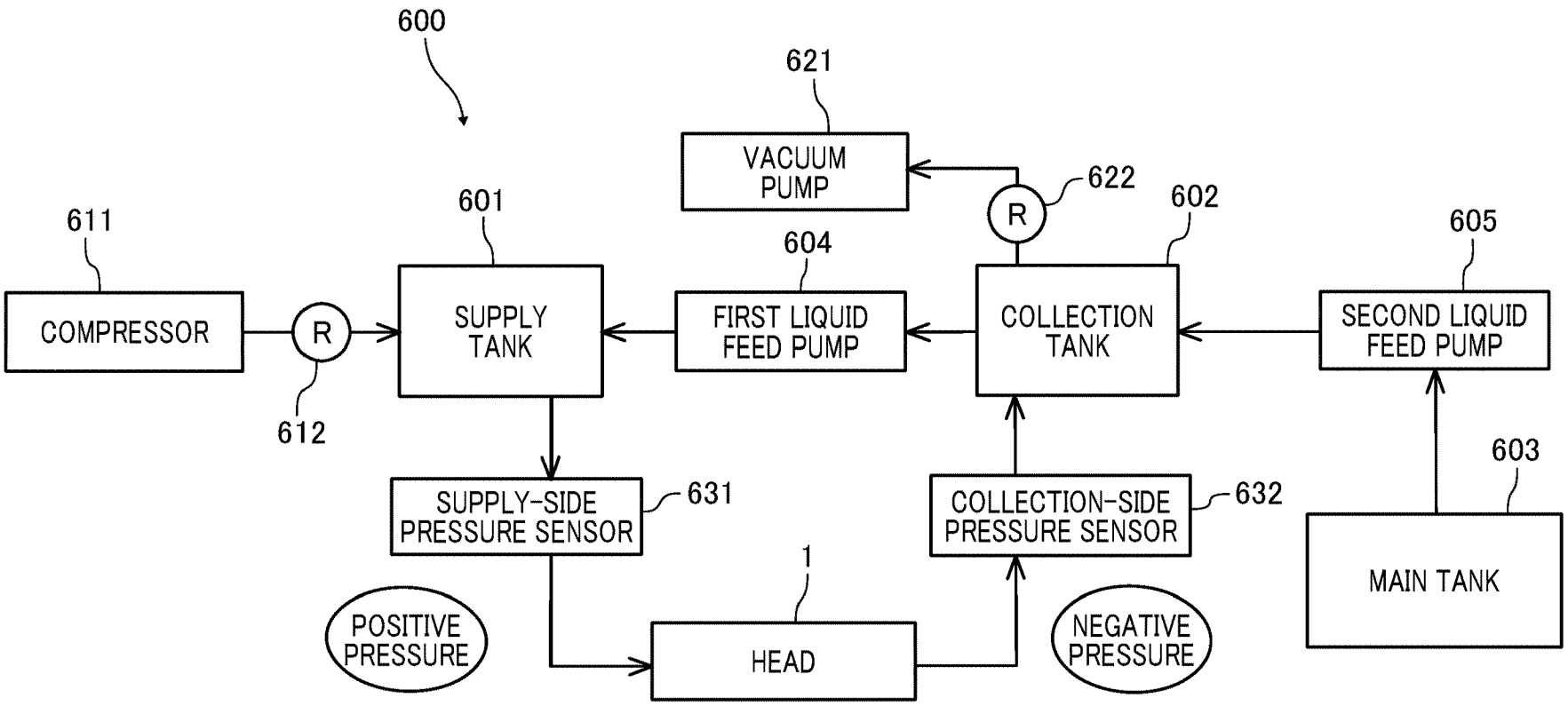
FIG. 21 is a circuit diagram illustrating an example of a liquid circulation device according to an embodiment of the present disclosure.

FIG. 21 illustrates an example of a liquid circulation device 600 employed in the printer 500 according to the present embodiment. FIG. 21 is a circuit diagram illustrating a structure of the liquid circulation device 600. Although only one head 1 is illustrated in FIG. 21, in the structure including a plurality of heads 1 as illustrated in FIG. 20, supply channels and collection channels are respectively coupled via manifolds or the like to the supply sides and collection sides of the plurality of heads 1.

The liquid circulation device 600 includes a supply tank 601, a collection tank 602, a main tank 603, a first liquid-feed pump 604, a second liquid-feed pump 605, a compressor 611, a regulator 612, a vacuum pump 621, a regulator 622, and a supply-side pressure sensor 631, and a collection-side pressure sensor 632, for example.

The compressor 611 and the vacuum pump 621 together generate a difference of pressure between a pressure in the supply tank 601 and a pressure in the collection tank 602.

The supply-side pressure sensor 631 is connected between the supply tank 601 and the head 1 and connected to the supply channels connected to the supply port 81 of the head 1. The collection-side pressure sensor 632 is connected between the head 1 and the collection tank 602 and is connected to the collection channels connected to the collection port 82 of the head 1.

One end of the collection tanks 602 is connected to the supply tank 601 via the first liquid-feed pump 604, and another end of the collection tanks 602 is connected to the main tank 603 via the second liquid-feed pump 605.

Accordingly, the liquid flows from the supply tank 601 into the head 1 via the supply port 81 and exits the head 1 from the collection port 82 into the collection tank 602. Further, the first liquid-feed pump 604 feeds the liquid from the collection tank 602 to the supply tank 601. Thus, the liquid circulation channel is constructed.

Here, a compressor 611 is connected to the supply tank 601 and is controlled so that a predetermined positive pressure is detected by the supply-side pressure sensor 631. Conversely, a vacuum pump 621 is connected to the collection tank 602 and is controlled so that a predetermined negative pressure is detected by the collection-side pressure sensor 632.

Such a configuration allows the menisci of ink in the nozzle 11 of the head 1 to be maintained at a constant negative pressure while circulating liquid through an interior of the head 1.

When liquids are discharged from the nozzles 11 of the head 1, the amount of liquid in each of the supply tank 601 and the collection tank 602 decreases. Therefore, the liquid is replenished from the main tank 603 to the collection tank 602 using the second liquid-feed pump 605 as appropriate.

The timing of supply of liquid from the main tank 603 to the collection tank 602 can be controlled in accordance with a result of detection by a liquid level sensor in the collection tank 602. For example, the liquid is supplied to the collection tank 602 from the main tank 603 when the liquid level in the collection tank 602 becomes lower than a predetermined height.

Figure 22:
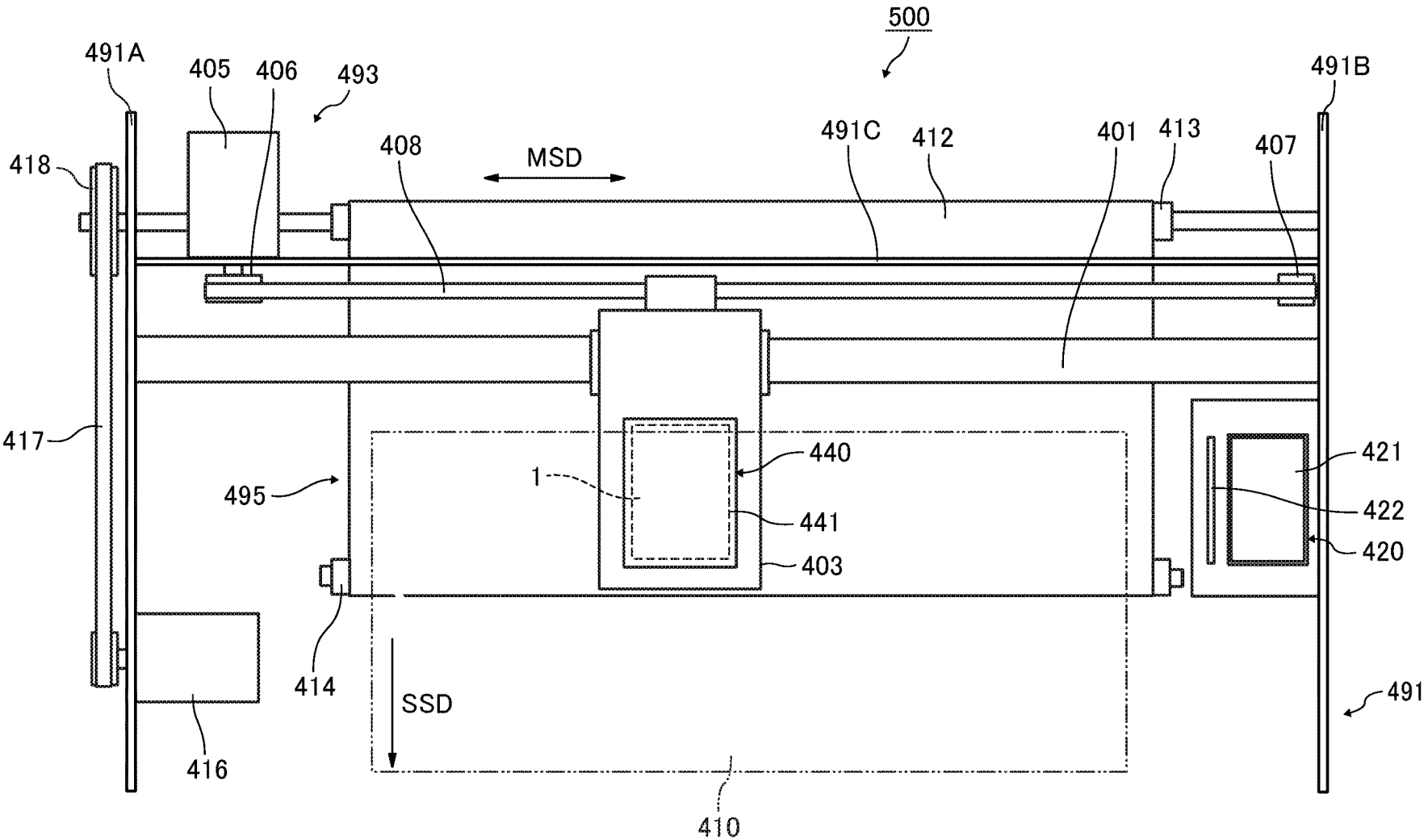
FIG. 22 is a plan view of a portion of a printer as a liquid discharge apparatus according to an embodiment of the present disclosure.
Figure 23:
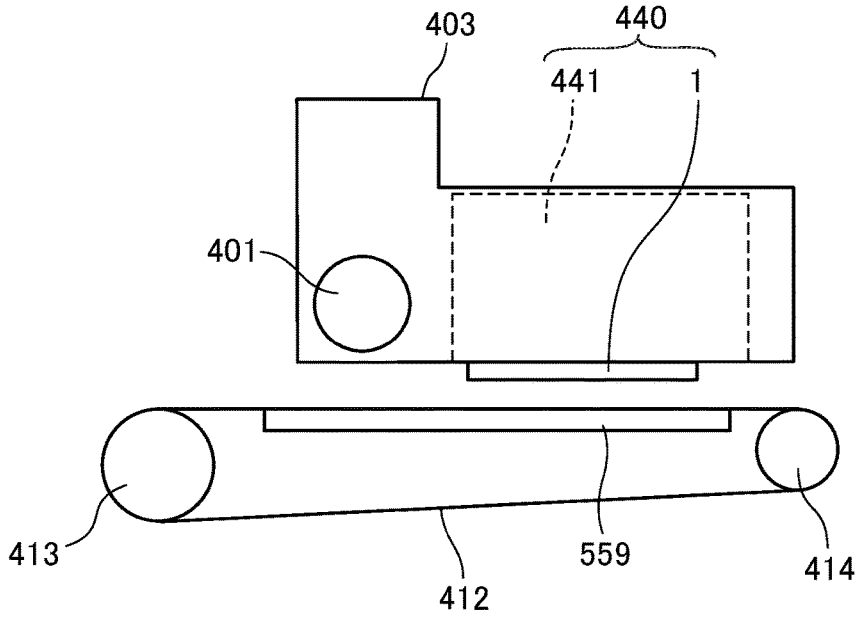
FIG. 23 is a schematic side view of a main portion of the liquid discharge apparatus of FIG. 22.

Next, another example of a printer 500 serving as a liquid discharge apparatus according to the present embodiment is described with reference to FIGS. 22 and 23. FIG. 22 is a plan view of a portion of the printer 500. FIG. 23 is a side view of a portion of the printer 500 of FIG. 22.

The printer 500 is a serial type apparatus, and the carriage 403 is reciprocally moved in a main scanning direction by the main scan moving unit 493. The main scanning direction is indicated by arrow "MSD" in FIG. 22. The main scan moving unit 493 includes a guide 401, a main scanning motor 405, and a timing belt 408. The guide 401 is bridged between a left-side plate 491A and a right-side plate 491B to movably hold the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 1 according to the present embodiment and a head tank 441 forms the liquid discharge device 440 as a single unit. The head tank 441 store the liquid to be supplied to the head 1.

The head 1 of the liquid discharge device 440 discharges liquid of each color, for example, yellow (Y), cyan (C), magenta (M), and black (K). The head 1 includes a nozzle array including a plurality of nozzles 11 arrayed in a sub-scanning direction indicated by arrow "SSD" perpendicular to the main scanning direction MSD. The head 1 is mounted to the carriage 403 so that liquids are discharged downward.

The head 1 is connected to the liquid circulation device 600 described above, and a liquid of a required color is circulated and supplied.

The printer 500 includes a conveyor 495 to convey a sheet 410. The conveyor 495 includes a conveyance belt 412 as a conveyor and a sub-scanning motor 416 to drive the conveyance belt 412.

The conveyance belt 412 attracts the sheet 410 and conveys the sheet 410 at a position facing the head 1. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance belt 412 cyclically rotates in the sub-scanning direction SSD as the conveyance roller 413 is rotationally driven by the sub-scanning motor 416 via the timing belt 417 and the timing pulley 418.

At one side in the main scanning direction MSD of the carriage 403, a maintenance unit 420 to maintain the head 1 in good condition is disposed on a lateral side of the conveyance belt 412.

The maintenance unit 420 includes, for example, a cap 421 to cap the nozzle surface of the head 1 and a wiper 422 to wipe the nozzle surface of the head 1.

The main scan moving unit 493, the maintenance unit 420, and the conveyor 495 are mounted to a housing 491 that includes a left-side plate 491A, a right-side plate 491B, and a rear-side plate 491C.

In the printer 500 thus configured, the sheet 410 is conveyed on and attracted to the conveyance belt 412 and is conveyed in the sub-scanning direction SSD by the cyclic rotation of the conveyance belt 412.

The head 1 is driven in response to image signals while the carriage 403 moves in the main scanning direction MSD, to discharge liquid to the sheet 410 stopped, thus forming an image on the sheet 410.

Figure 24:
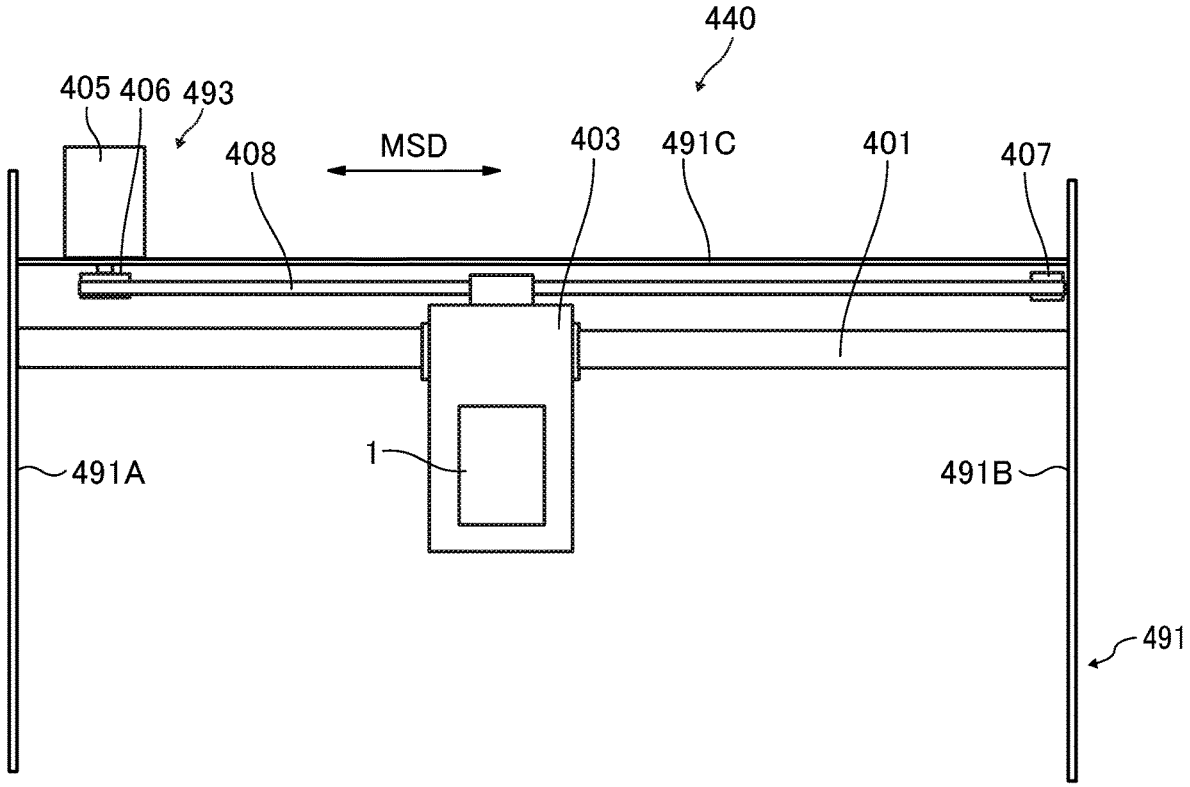
FIG. 24 is a plan view of a portion of another example of a liquid discharge device.

Next, the liquid discharge device 440 according to another embodiment of the present embodiment is described with reference to FIG. 24. FIG. 24 is a plan view of a portion of another example of the liquid discharge device 440.

The liquid discharge device 440 includes the housing 491, the main scan moving unit 493, the carriage 403, and the head 1 among components of the printer 500 (liquid discharge apparatus) illustrated in FIG. 22. The housing 491 includes the left-side plate 491A, the right-side plate 491B, and the rear-side plate 491C.

Note that, in the liquid discharge device 440, the maintenance unit 420 described above may be mounted on, for example, the right-side plate 491B.

Figure 25:
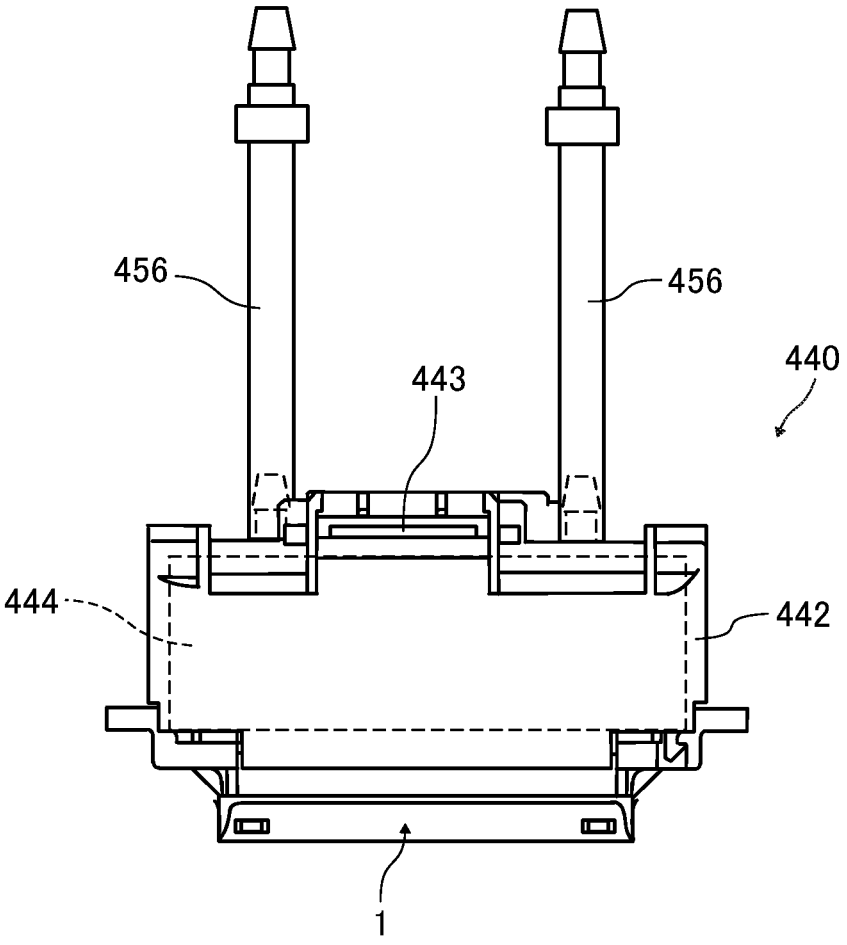
FIG. 25 is a front view of the liquid discharge device according to still another embodiment of the present disclosure.

Next, still another example of the liquid discharge device 440 according to the present embodiment is described with reference to FIG. 25. FIG. 25 is a front view of still another example of the liquid discharge device 440.

The liquid discharge device 440 includes the head 1, to which a channel part 444 is attached, and a tube 456 connected to the channel component 444.

Further, the channel part 444 is disposed inside a cover 442. Instead of the channel part 444, the liquid discharge device 440 may include the head tank 441. A connector 443 electrically connected with the head 1 is provided on an upper part of the channel part 444.

In the present embodiment, discharged liquid is not limited to a particular liquid as long as the liquid has a viscosity or surface tension to be discharged from a head (liquid discharge head).

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. A unit including a filter may be added at a position between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head to which the head tank or the channel member is attached so that the head and a supply unit form a single unit. Liquid is supplied from a liquid reservoir source to the head via the tube.

The main scan moving unit may be a guide only. The supply unit may be a tube(s) only or a loading unit only.

In another example, the "liquid discharge device" may be a single unit in which the head and other functional parts are combined with each other. The "liquid discharge device" includes a head module including the above-described head, and a head device in which the above-described functional components and mechanisms are combined to form a single unit.

The term "liquid discharge apparatus" used herein also represents an apparatus including the head, the liquid discharge device, the head module, and the head device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation," "recording," "printing," "image printing," and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles configured to discharge a liquid, the plurality of nozzles arrayed in a two-dimensional matrix forming a plurality of nozzle groups;

a plurality of pressure chambers communicating with the plurality of nozzles, respectively;

a plurality of supply ports communicating with the plurality of pressure chambers, respectively;

a plurality of common-supply branch channels communicating with two or more of the plurality of pressure chambers through the plurality of supply ports, respectively;

a plurality of collection ports communicating with the plurality of pressure chambers, respectively;

a plurality of common-collection branch channels communicating with two or more of the plurality of pressure chambers through the plurality of collection ports, respectively;

a plurality of bypass supply ports, each of which is adjacent to one of the plurality of supply ports at each longitudinal end of one of the plurality of common-supply branch channels in one of the plurality of the nozzle groups;

a plurality of bypass collection ports each of which is adjacent to one of the plurality of collection ports at each longitudinal end of one of the plurality of common-collection branch channels in the one of the plurality of nozzle groups; and a plurality of bypass channels connecting the plurality of bypass supply ports and the plurality of bypass collection ports, respectively.

2. The liquid discharge head according to claim 1, wherein each of the plurality of bypass channels connects one of the plurality of common-supply branch channels and one of the plurality of common-collection branch channels that are adjacent to each other.

3. The liquid discharge head according to claim 1, wherein a distance between one of the plurality of bypass supply ports and one of the plurality of supply ports adjacent to the one of the plurality of bypass supply ports is same as a distance between adjacent two of the plurality of supply ports.

4. The liquid discharge head according to claim 1, wherein a distance between one of the plurality of bypass collection ports and one of the plurality of collection ports adjacent to the one of the plurality of bypass collection ports is same as a distance between adjacent two of the plurality of collection ports.

5. The liquid discharge head according to claim 1, wherein a fluid resistance of a path from one of the plurality of supply ports to one of the plurality of collection ports via one of the plurality of pressure chambers is same as a fluid resistance of a path from one of the plurality of bypass supply ports to one of the plurality of bypass collection ports via one of the plurality of bypass channels.

6. A liquid discharge head according to claim 1, wherein the plurality of bypass channels is formed in a channel plate in which the plurality of pressure chambers is formed.

7. The liquid discharge head according to claim 1, wherein each of the plurality of bypass channels is a groove formed on a partition wall between one of the plurality of common-supply branch channels and one of the plurality of common-collection branch channels adjacent to each other.

8. The liquid discharge head according to claim 1, further comprising:

a plurality of supply-side dampers forming part of walls of the plurality of common-supply branch channels, respectively, wherein the plurality of nozzles includes a first nozzle and a second nozzle disposed closest to the first nozzle, the plurality of supply ports includes a first supply port communicating with the first nozzle and a second supply port communicating with the second nozzle, the first supply port and the second supply port are in an identical one of the plurality of common-supply branch channels, and the first supply port and the second supply port are spaced apart by a distance greater than a distance between one of the first supply port and the second supply port and one of the plurality of supply-side dampers facing the one of the first supply port and the second supply port.

9. A liquid discharge head according to claim 8, wherein the first supply port and the second supply port are in an identical one of the plurality of common-supply branch channels, and wherein the plurality of supply ports further includes a third supply port in the identical one of the plurality of common-supply branch channels, and the third supply port and one of the first supply port and the second supply port are spaced apart by a distance shorter than the distance between the first supply port and the second supply port.

10. The liquid discharge head according to claim 8, wherein the plurality of supply-side dampers faces the plurality of the supply ports, respectively.

11. The liquid discharge head according to claim 8, further comprising a plurality of collection-side dampers forming part of walls of the plurality of common-collection branch channels, respectively.

12. The liquid discharge head according to claim 11, wherein the plurality of nozzles includes a third nozzle and a fourth nozzle disposed closest to the third nozzle;

the plurality of collection ports includes a first collection port communicating with the third nozzle and a second collection port communicating with the fourth nozzle;

the first collection port and the second collection port are arranged in an identical one of the plurality of common-collection branch channels;

the plurality of collection ports further includes a third collection port in the identical one of the plurality of common-collection branch channels; and the third collection port and one of the first collection port and the second collection port are spaced apart by a distance shorter than the distance between the first collection port and the second collection port.

13. The liquid discharge head according to claim 12, wherein the first collection port and the second collection port are spaced apart by a distance greater than a distance between one of the first collection port and the second collection port and one of the plurality of collection-side dampers facing the one of the first collection port and the second collection port.

14. A liquid discharge head according to claim 11, wherein the plurality of collection-side dampers faces the plurality of the collection ports, respectively.

15. The liquid discharge head according to claim 14, wherein an identical damper member forms the plurality of supply-side dampers and the plurality of collection-side dampers; and each of the plurality of common-supply branch channels and the plurality of common-collection branch channels is formed of the identical damper member that seals grooves formed on an identical common-channel member.

16. A head module comprising a plurality of liquid discharge heads including the liquid discharge head according to claim 1, wherein the plurality of liquid discharge heads is arrayed in one direction.

17. A head device comprising a plurality of head modules including the head module according to claim 16, wherein the plurality of head modules is arrayed in the one direction.

18. A liquid discharge device comprising the liquid discharge head according to claim 1.

19. The liquid discharge device according to claim 18, wherein the liquid discharge head and at least one of a head tank to store the liquid to be supplied to the liquid discharge head, a carriage on which the liquid discharge head is mounted, a supply unit to supply the liquid to the liquid discharge head, a maintenance unit to maintain the liquid discharge head, and a main scan moving unit to move the liquid discharge head in a main scanning direction form a single unit.

20. A liquid discharge apparatus comprising the liquid discharge device according to claim 18.

* * * * *